US009233794B2

(12) United States Patent
Anderson

(10) Patent No.: US 9,233,794 B2
(45) **Date of Patent: *Jan. 12, 2016**

(54) CART WITH LATCH

(75) Inventor: Barry Anderson, Sheboygan, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 15 days.

This patent is subject to a terminal disclaimer.

(21) Appl. No.: 14/236,304

(22) PCT Filed: Jul. 31, 2012

(86) PCT No.: PCT/US2012/049024

§ 371 (c)(1),
(2), (4) Date: Jan. 30, 2014

(87) PCT Pub. No.: WO2013/019807

PCT Pub. Date: Feb. 7, 2013

(65) Prior Publication Data

US 2014/0158689 A1 Jun. 12, 2014

Related U.S. Application Data

(63) Continuation of application No. 13/195,235, filed on Aug. 1, 2011, now Pat. No. 8,627,976.

(60) Provisional application No. 61/577,139, filed on Dec. 19, 2011.

(51) Int. Cl.
*B65F 1/16* (2006.01)
*B65F 1/14* (2006.01)

(52) U.S. Cl.
CPC ..... *B65F 1/16* (2013.01); *B65F 1/1468* (2013.01); *B65F 1/163* (2013.01); *B65F 1/1615* (2013.01); *B65F 1/1623* (2013.01)

(58) Field of Classification Search
CPC ..... B65F 1/16; B65F 1/1623; B65F 1/1468; B65F 1/1615; B65F 1/163
USPC ..... 220/326, 324, 315, 830, 827, 81 O, 220/254.6, 254.5, 254.3, 908, 264, 263, 220/262, 81
See application file for complete search history.

(56) References Cited

U.S. PATENT DOCUMENTS 3,041,030 A * 6/1962 Heimrich ..... 248/129
3,275,363 A 9/1966 Bates (Continued)

FOREIGN PATENT DOCUMENTS

WO 00/09410 A1 2/2000

OTHER PUBLICATIONS

International Search Report for PCT/US2012/049024 completed Oct. 8, 2012 (1 page).

*Primary Examiner* — Robert J Hicks
*Assistant Examiner* — Kareen Thomas
(74) *Attorney, Agent, or Firm* — Michael Best & Friedrich LLP

(57) ABSTRACT

A cart including a container that defines an interior space. The cart also includes a cover that is movable between an open position providing access to the interior space and a closed position inhibiting access to the interior space, and a latch that is located between the container and the cover to releasably hold the cover in the closed position. The cart further includes a hands-free mechanism that is coupled to the container and engaged with the cover to move the cover between the open position and the closed position. The hands-free mechanism is further coupled to the latch and operable to disengage the latch to permit movement of the cover to the open position.

42 Claims, 32 Drawing Sheets

(56) References Cited

U.S. PATENT DOCUMENTS 3,347,507 A 10/1967 Dyer
5,048,712 A * 9/1991 Wolters ..... 220/262
5,163,574 A 11/1992 Sosan
7,114,629 B2 * 10/2006 Panek, Jr. ..... A61B 19/0287 220/23.87

* cited by examiner

CART WITH LATCH

RELATED APPLICATIONS

This application claims the benefit of and priority to U.S. patent application Ser. No. 13/195,235, filed Aug. 1, 2011, and to U.S. Provisional Patent Application No. 61/577,139, filed Dec. 19, 2011, the entire contents of each of which are incorporated herein by reference.

BACKGROUND

The present invention relates generally to a cart including a waste container for disposal of contaminated articles or other refuse. More particularly, the present invention relates to a cart including a waste container, a cover for the container, and a latch for holding the cover closed.

Most waste containers include a cover that is positioned over an interior space of the container. Generally, the cover is manipulatable between an open position allowing disposal of waste, and a closed position limiting access to the interior space. Sometimes, it is desirable to move or transport these containers to provide more space in a particular area or to empty the containers. However, these existing covers can be inadvertently opened if the container tips over, exposing the contents of the container and possibly spilling the contents of the container into the surrounding area. Such inadvertent exposure can be severely detrimental when the waste container holds biomedical or chemical waste.

SUMMARY

In one construction, the present invention provides a cart including a container that defines an interior space. The cart also includes a cover that is movable between an open position providing access to the interior space and a closed position inhibiting access to the interior space, and a latch that is located between the container and the cover to releasably hold the cover in the closed position. The cart further includes a hands-free mechanism that is coupled to the container and engaged with the cover to move the cover between the open position and the closed position. The hands-free mechanism is further coupled to the latch and operable to disengage the latch to permit movement of the cover to the open position.

In another construction, the cart includes a latch that is coupled to the cover and that has an unlatched state permitting movement of the cover to the open position and a latched state inhibiting movement of the cover to the open position. The cart also includes a hands-free mechanism that is coupled to the container and the latch and that is movable a first distance to vary the latch from the latched state to the unlatched state. The hands-free mechanism is further movable a second distance beyond the first distance to move the cover from the closed position to the open position.

In another construction, the cart includes a latch that is coupled between the container and the cover. The latch is variable between an unlatched state in which the latch is disengaged from one of the container and the cover to permit movement of the cover to the open position, and a latched state in which the latch is engaged with the one of the container and the cover to inhibit movement of the cover to the open position. The cart also includes a caddy that supports the container and that has a hands-free mechanism with a foot pedal operatively coupled to the latch and the cover to vary the latch between the latched state and the unlatched state and to move the cover from the closed position to the open position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
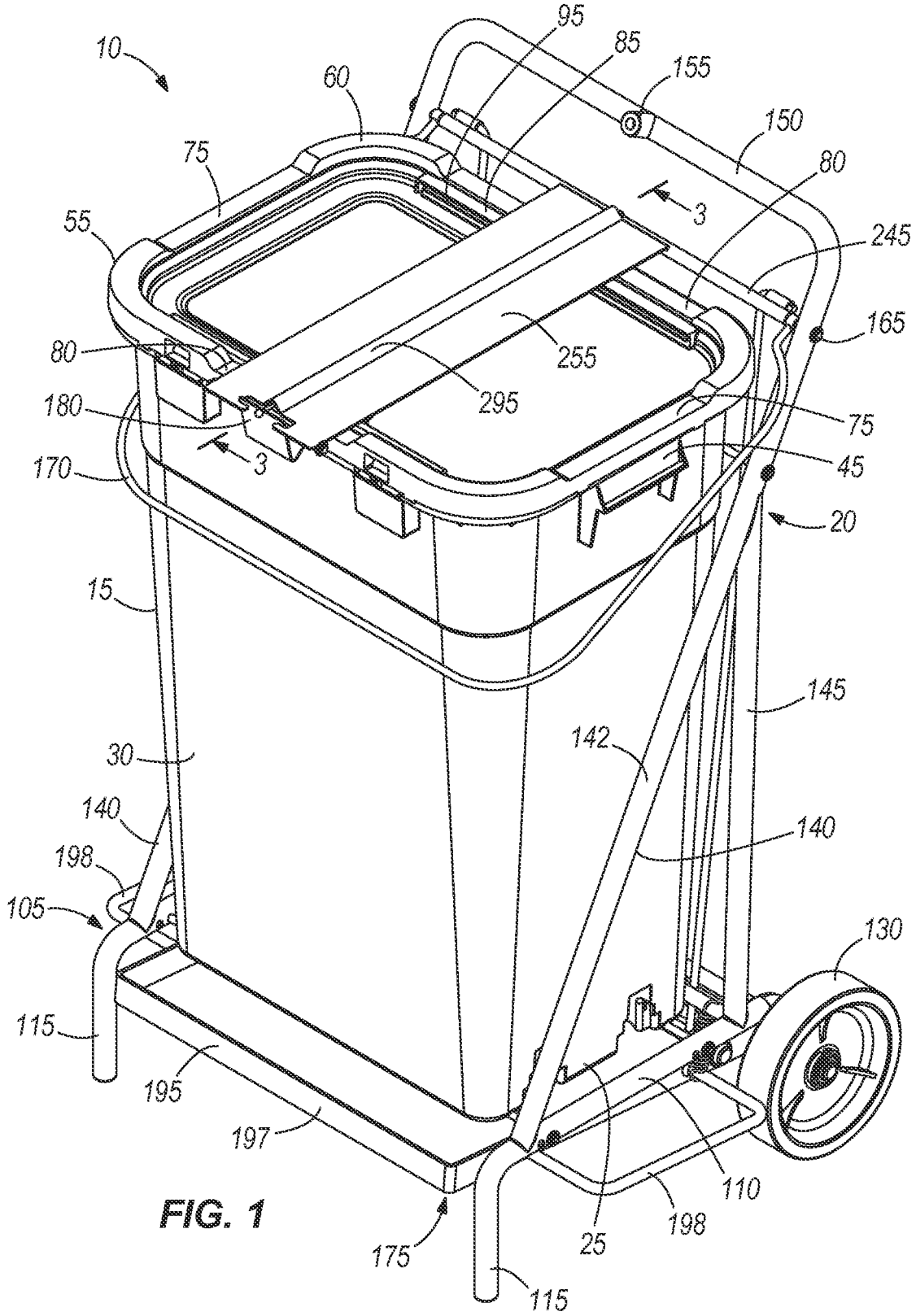
FIG. 1 is a perspective view of a cart embodying the present invention and including a caddy, a container supported on the caddy, and a latch.
Figure 2:
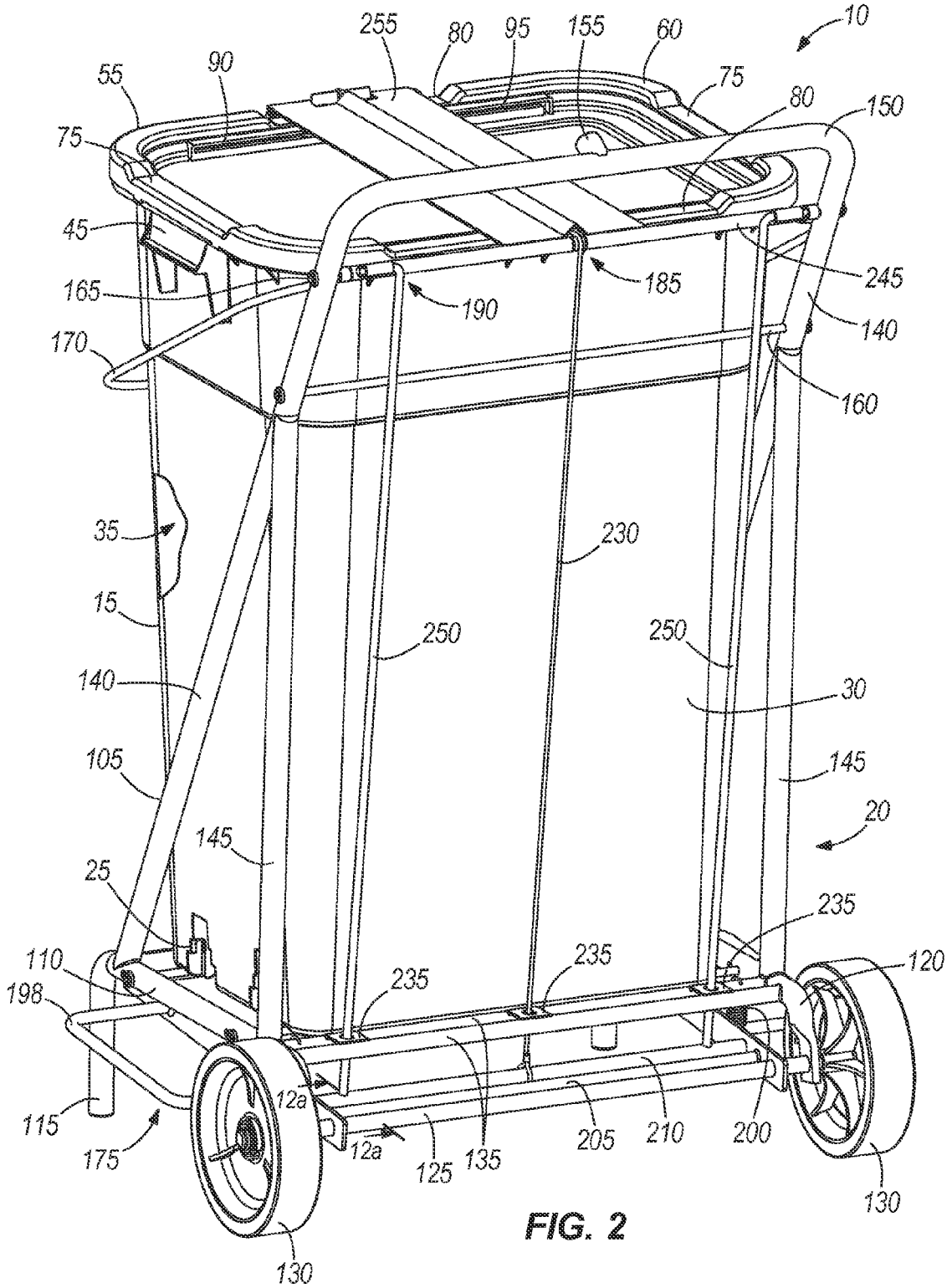
FIG. 2 is another perspective view of the cart of FIG. 1 illustrating a first linkage operatively coupled to the latch and a second linkage operatively engaged with a cover for the container.
Figure 6:
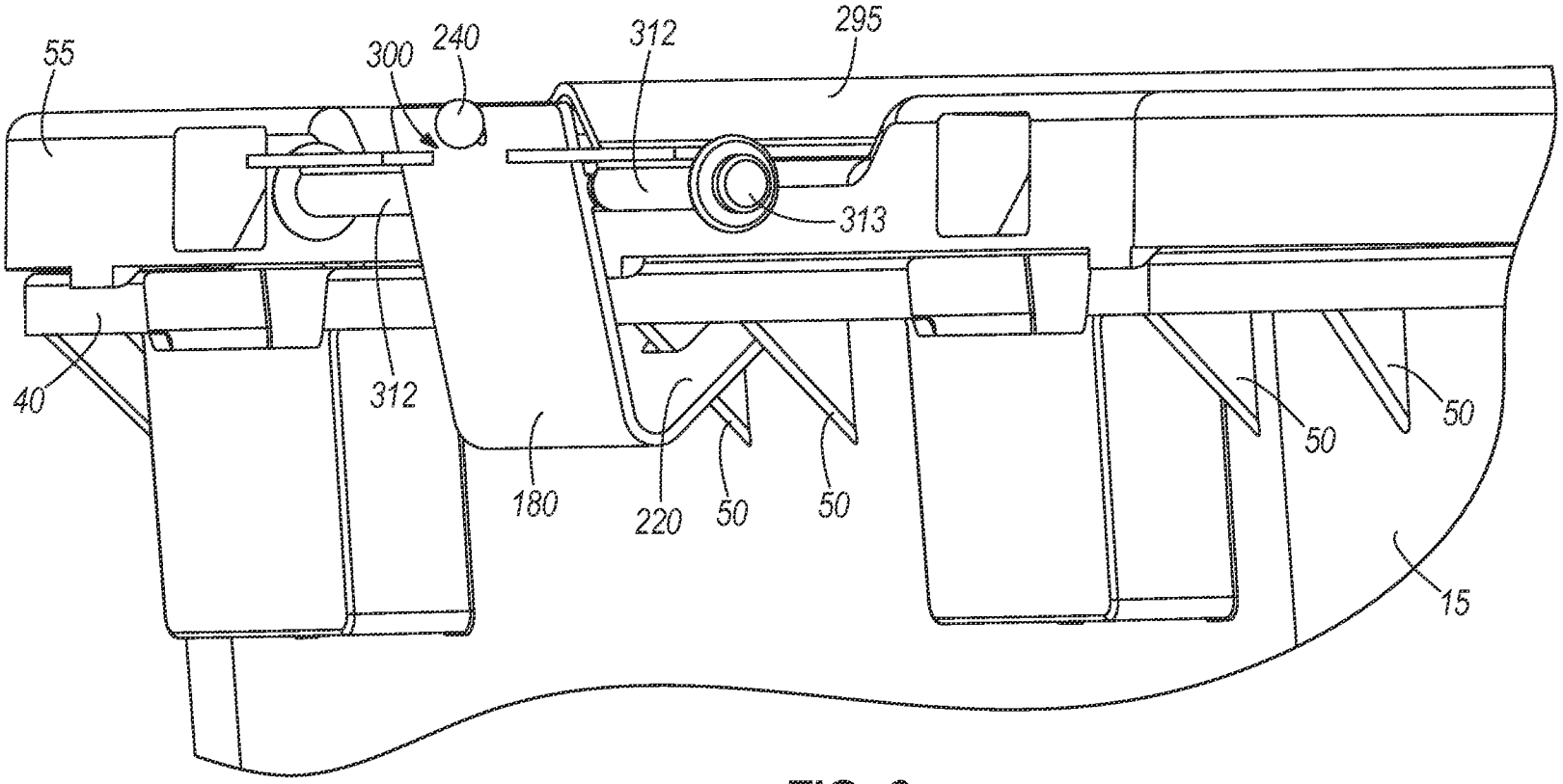
FIG. 6 is a perspective view of an upper portion of the cart showing the latch in a latched state.

FIGS. 1 and 2 show a cart 10 including a container 15 and a caddy 20 for supporting the container 15. The illustrated container 15 is a waste container 15 including a base portion 25 and a sidewall 30 that cooperatively define an interior space 35 for storing contaminated articles or other refuse (e.g., trash, biomedical waste such as sharps objects, bodily fluids, etc.). The top of the sidewall 30 also includes a lip or flange 40 (FIG. 11*a*) that surrounds and defines an opening to the interior space 35. Handles 45 are located on opposite sides of the container 15 adjacent the flange 40 and can be used to move the container 15. With reference to FIG. 6, the container 15 also includes stiffener ribs 50 spaced around the top of the sidewall 30. The ribs 50 extend between the sidewall 30 and the flange 40 to stiffen the flange 40.

Figure 3A:
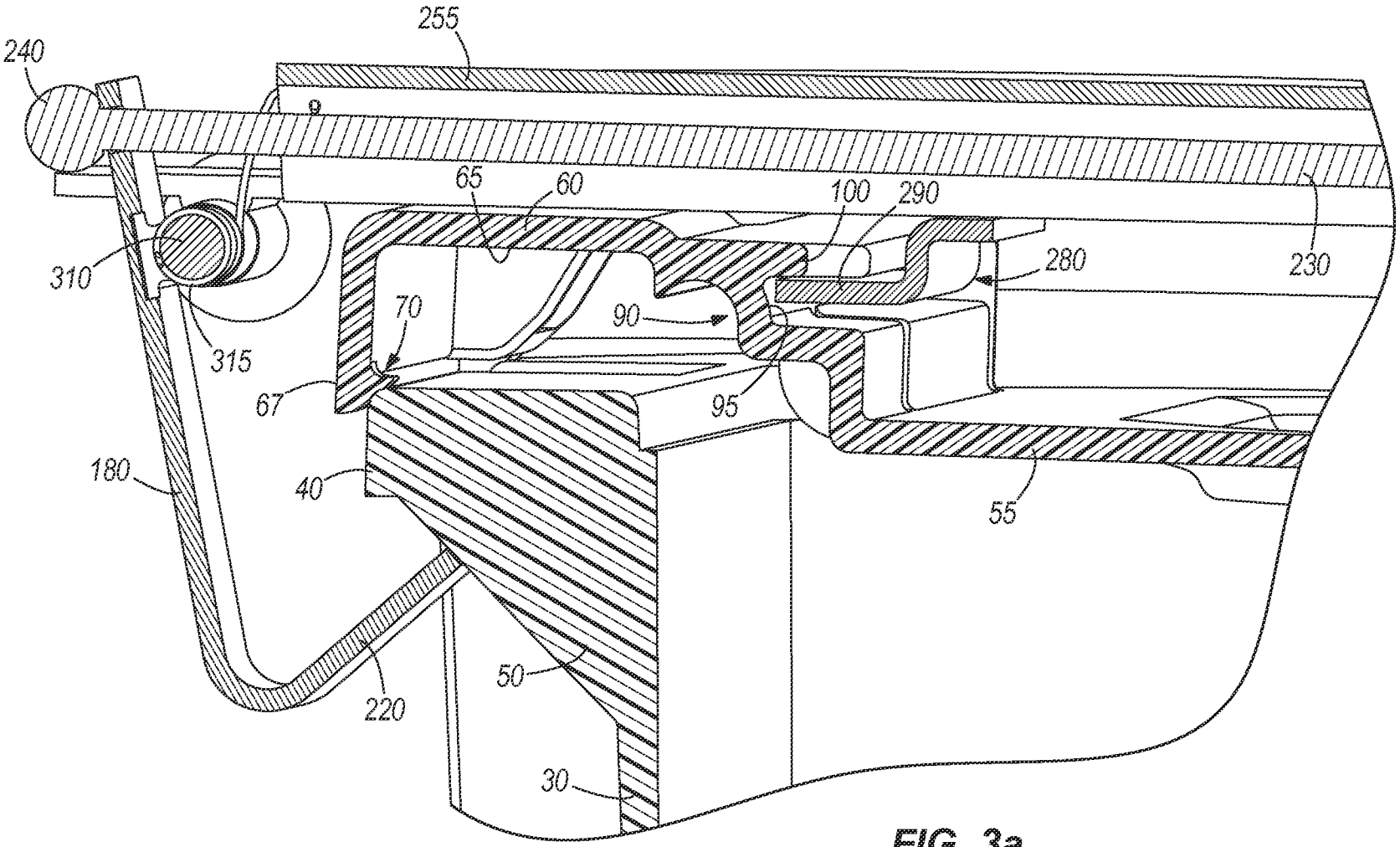
FIG. 3*a* is a section view of a front portion of the cart of FIG. 1 taken along line 3-3 and illustrating a portion of the first linkage and the second linkage.
Figure 3B:
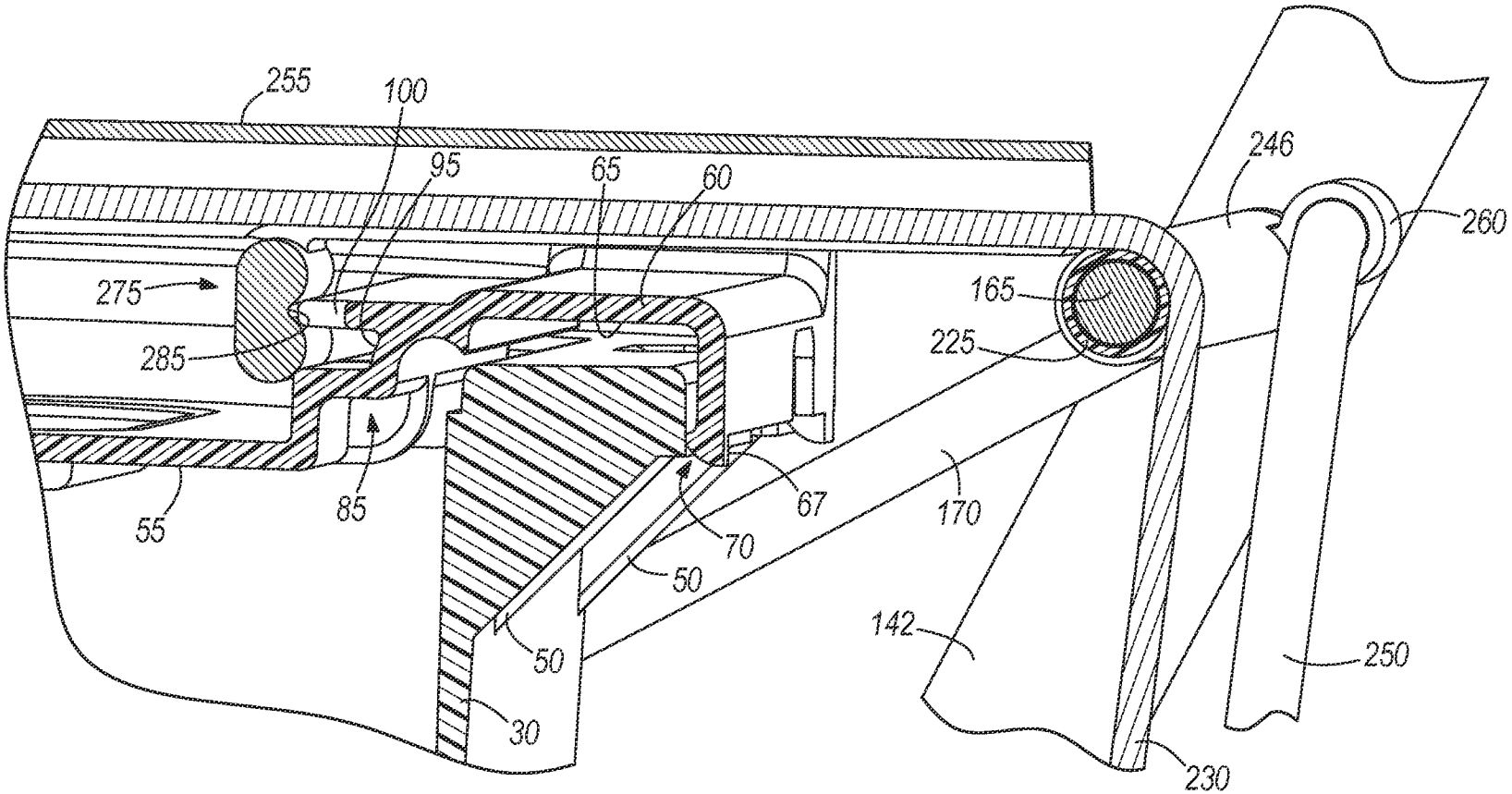
FIG. 3*b* is a section view of a rear portion of the cart of FIG. 1 taken along line 3-3 and illustrating a portion of the first linkage and the second linkage.
Figure 8:
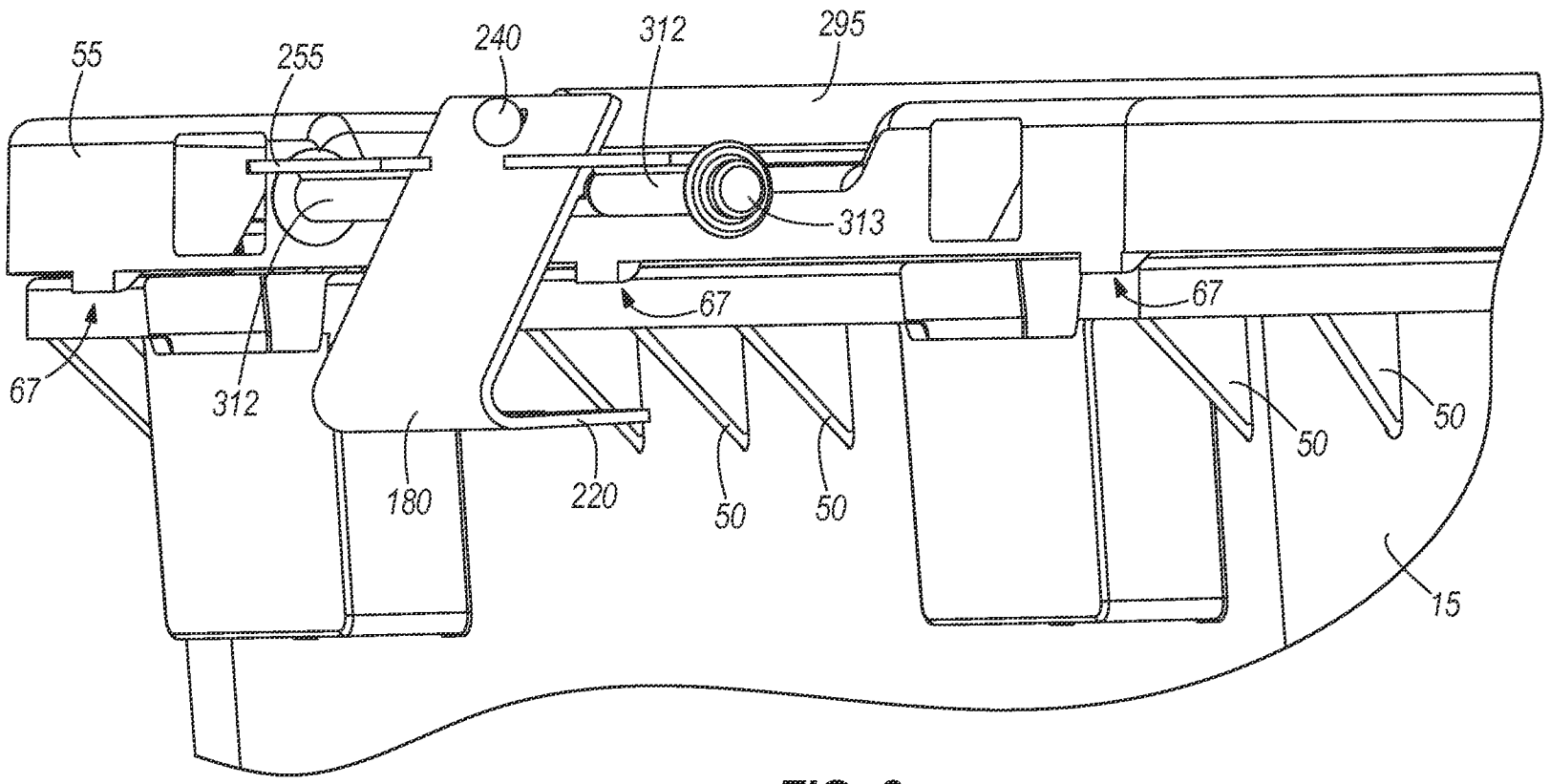
FIG. 8 is a view similar to FIG. 6 showing the latch in an unlatched state.
Figure 9A:
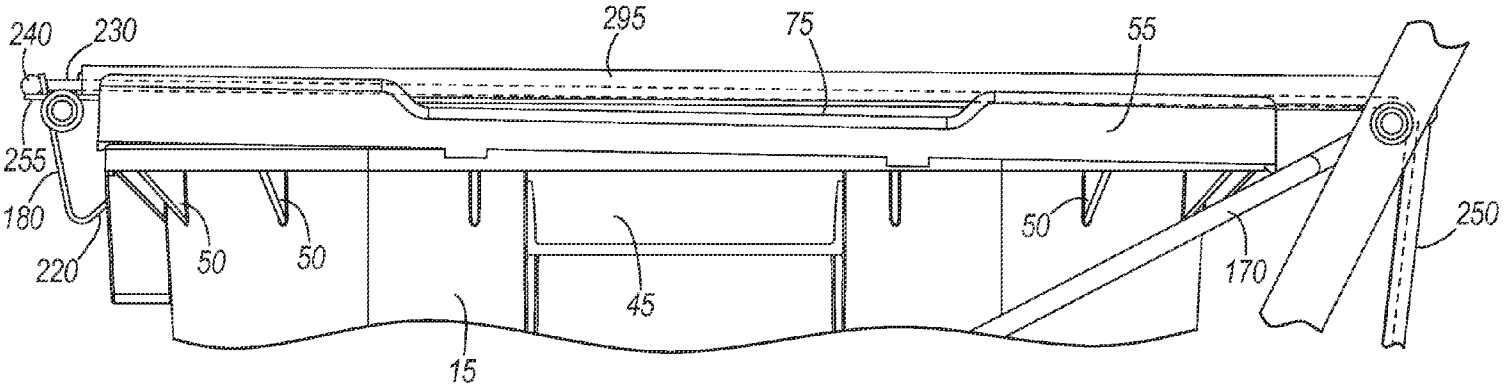
FIG. 9*a* is a side view of the upper portion of the cart showing the latch in the latched state and the cover in a closed position.

With reference to FIGS. 1-3*b* and 6, a cover 55 is seated on the container 15 and engages the flange 40 to enclose the interior space 35. Generally, the cover 55 is movable between an open or removed position (FIG. 11*a*) that provides access to the interior space 35 and a closed position (FIG. 9*a*) that inhibits access to the interior space 35. The cover 55 has a peripheral engagement portion 60 disposed along the outer edge of the cover 55. With reference to FIGS. 3*a*, and 3*b* and 8, the peripheral engagement portion 60 defines a recess or channel 65 shaped to receive the flange 40. A plurality of tabs 67 are disposed on exterior edges of the engagement portion 60 (three on the front and back and two on each side). Each tab 67 has a tapered lip 70 engageable with the underside of the flange 40 to hold the cover 55 in a snapped-down position (e.g., when the container 15 is full). When the cover is in the closed position and pushed down, the tabs 67 flex outward and then snap in when the lips 70 pass the lower edge of the flange 40, such that the upper surfaces of the lips engage the underside of the flange 40. This releasably secures the cover in the snapped-down position. Thus, in the illustrated construction, the "closed position" is not the most secure position of the cover, but is a position in which the interior space is not accessible. In alternative embodiments the "closed position" can also be the most secure or lowermost position.

The peripheral engagement portion 60 of the cover 55 also has (see FIG. 1) first recessed sections 75 that are disposed on opposite sides of the cover 55 and that are aligned with the handles 45, and second recessed sections 80 that are disposed along the front and rearward sides of the cover 55 to accommodate a cover lifting mechanism as explained below. The recessed sections 75 align with the handles 45 when the cover 55 is placed on the container 15 to make it easier to move the container 15 via the handles 45.

The cover 55 also includes a first or rear attachment section 85 (FIGS. 1 and 3*b*) disposed adjacent the rear of the cover 55 along an inward edge of the peripheral engagement portion 60, and a second or front attachment section 90 (FIGS. 2 and 3*a*) disposed adjacent the front of the cover 55 along an inward edge of the peripheral engagement portion 60. Each of the attachment sections 85, 90 has an elongated groove 95 that is defined along an upward edge by an inwardly extending projection 100.

FIGS. 1, 2, 4, and 5 show that the caddy 20 includes a frame 105 for supporting the container 15 in an upright orientation. As illustrated, the frame 105 is tubular, although the frame 105 can be a wireframe or any other type of frame that is suitable for supporting the container 15. The frame 105 includes base frame members 110 for supporting the container 15 and the caddy 20 on a surface (e.g., the floor). In particular, each base frame member 110 has adjacent its forward end a leg 115 engageable with the floor, and each base frame member 110 has an axle support portion 120 adjacent its rearward end. The axle support portions 120 support an axle 125 that rotatably couples wheels 130 to the caddy 20. The legs 115 and the wheels 130 support the caddy 20 on the floor. With reference to FIG. 2, frame supports 135 are coupled to and extend between the base frame members 110 adjacent the rearward ends of the base frame members 110. As illustrated, the frame supports 135 are spaced apart a small distance.

The frame 105 also includes (see FIG. 4) a primary upright frame member 140 that is coupled (e.g., welded) to each of the base frame members 110. The frame member 140 includes side portions 142 that extend upward and rearward from the base frame members 110 adjacent the forward ends of the members 110. The frame member 140 also includes a handle 150 that extends horizontally between the upper ends of the side portions 142. A protrusion or stop 155 is coupled to the handle 150. The frame 105 also includes secondary upright frame members 145 coupled between respective base frame members 110 and respective side portions 142 to provide structural support for the frame member 140. The frame members 140 and 145 limit lateral movement of the container 15 relative to the caddy 20.

Figure 4:
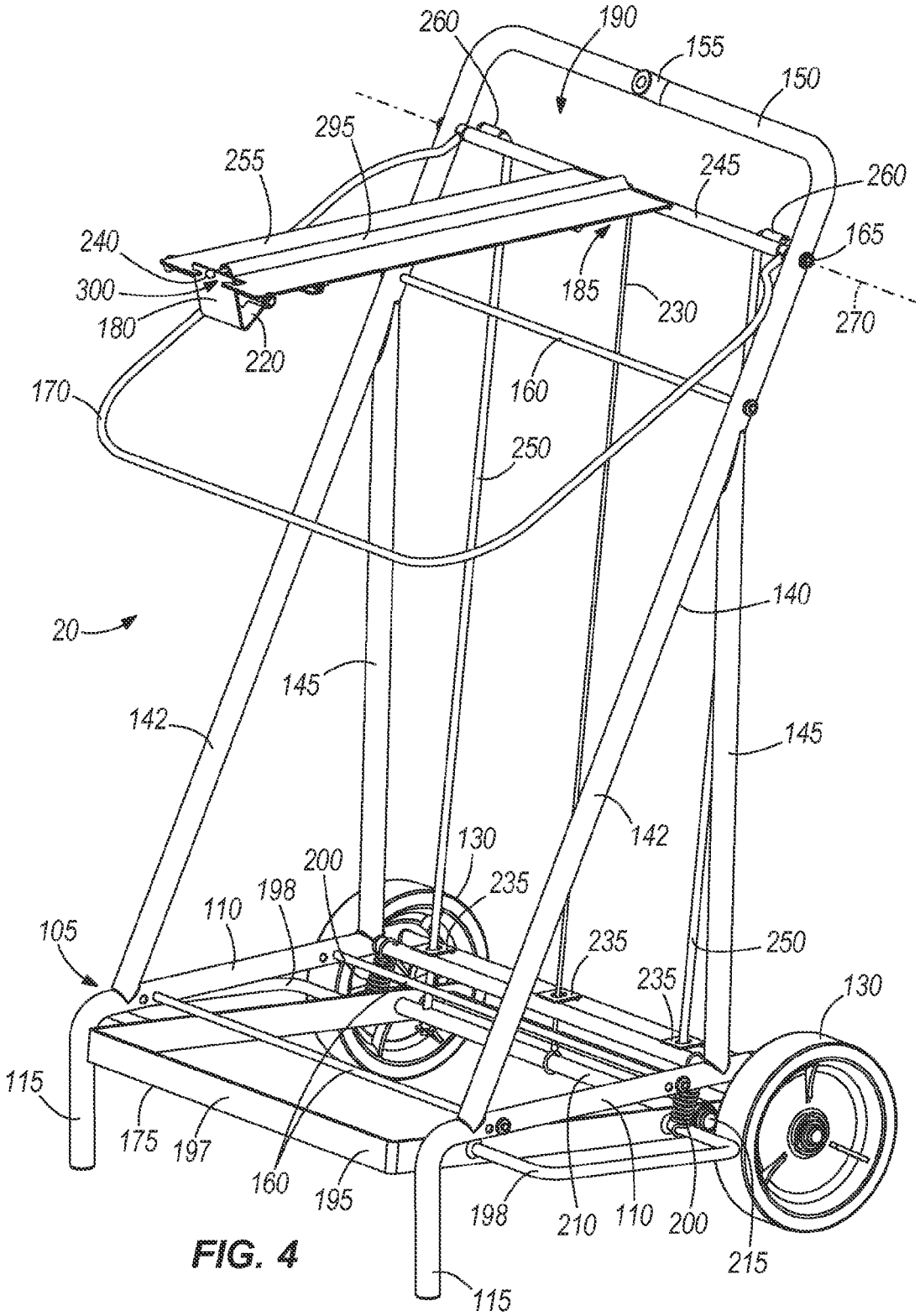
FIG. 4 is a perspective view of the caddy of FIG. 1 including the first linkage and the second linkage.
Figure 9B:
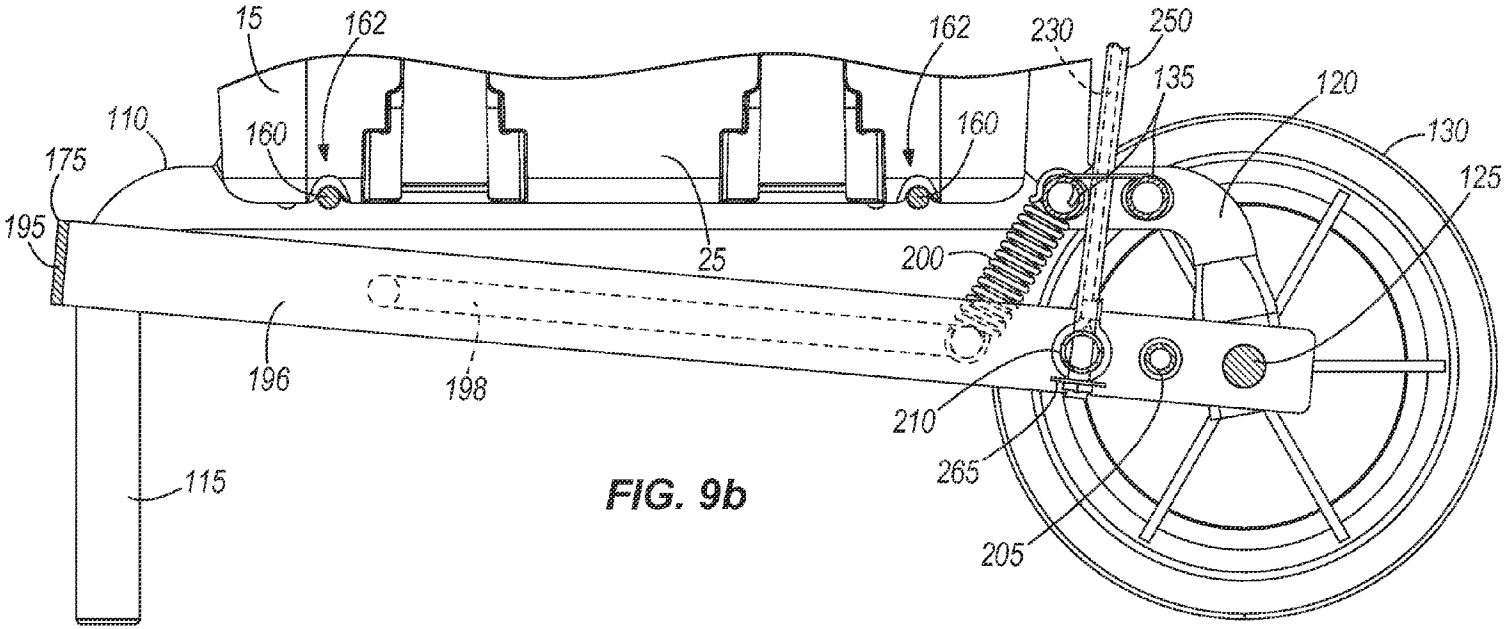
FIG. 9*b* is a section view taken along line 9*b*-9*b* of FIG. 7 showing the lower portion of the cart with a foot pedal in a normal or upper position.

As shown in FIGS. 1 and 2, the base frame members 110, the frame member 140, and the frame members 145 cooperate to define a container support area so that the container 15 is partially surrounded by the frame 105. Container supports 160 (see FIG. 4) are coupled to and extend between the base frame members 110 to support the base portion 25 of the container 15 on the caddy 20. As shown in FIG. 9*b*, the bottom of the container 15 has therein laterally extending grooves 162 in which the supports 160 are seated to limit movement of the container 15 relative to the caddy 20. An upper container support 160 also extends between the side portions 142, as shown in FIG. 4. This upper support 160 limits rearward movement of the container on the caddy.

Figure 5:
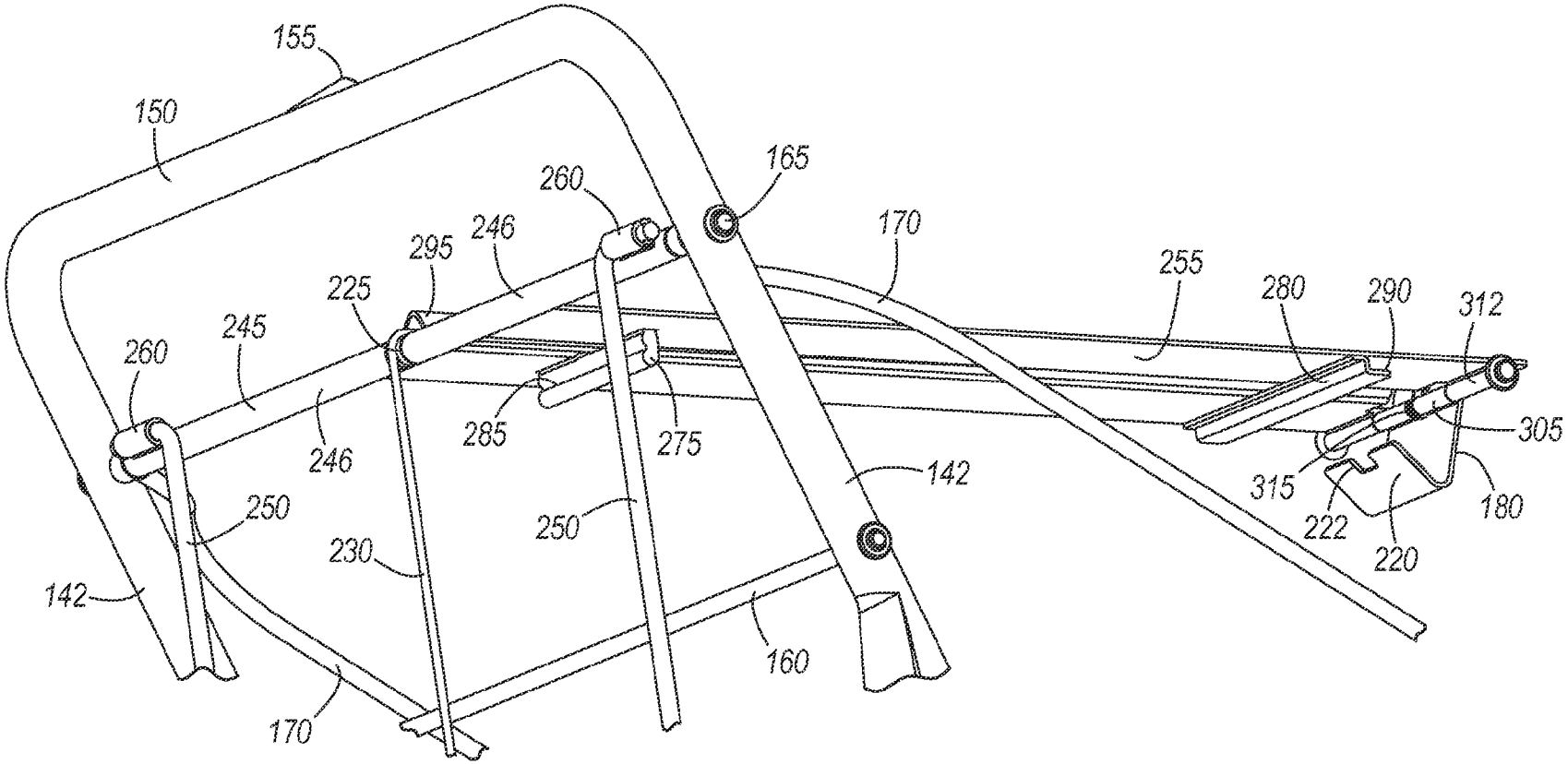
FIG. 5 is a perspective view of the upper portion of the caddy.
Figure 5A:
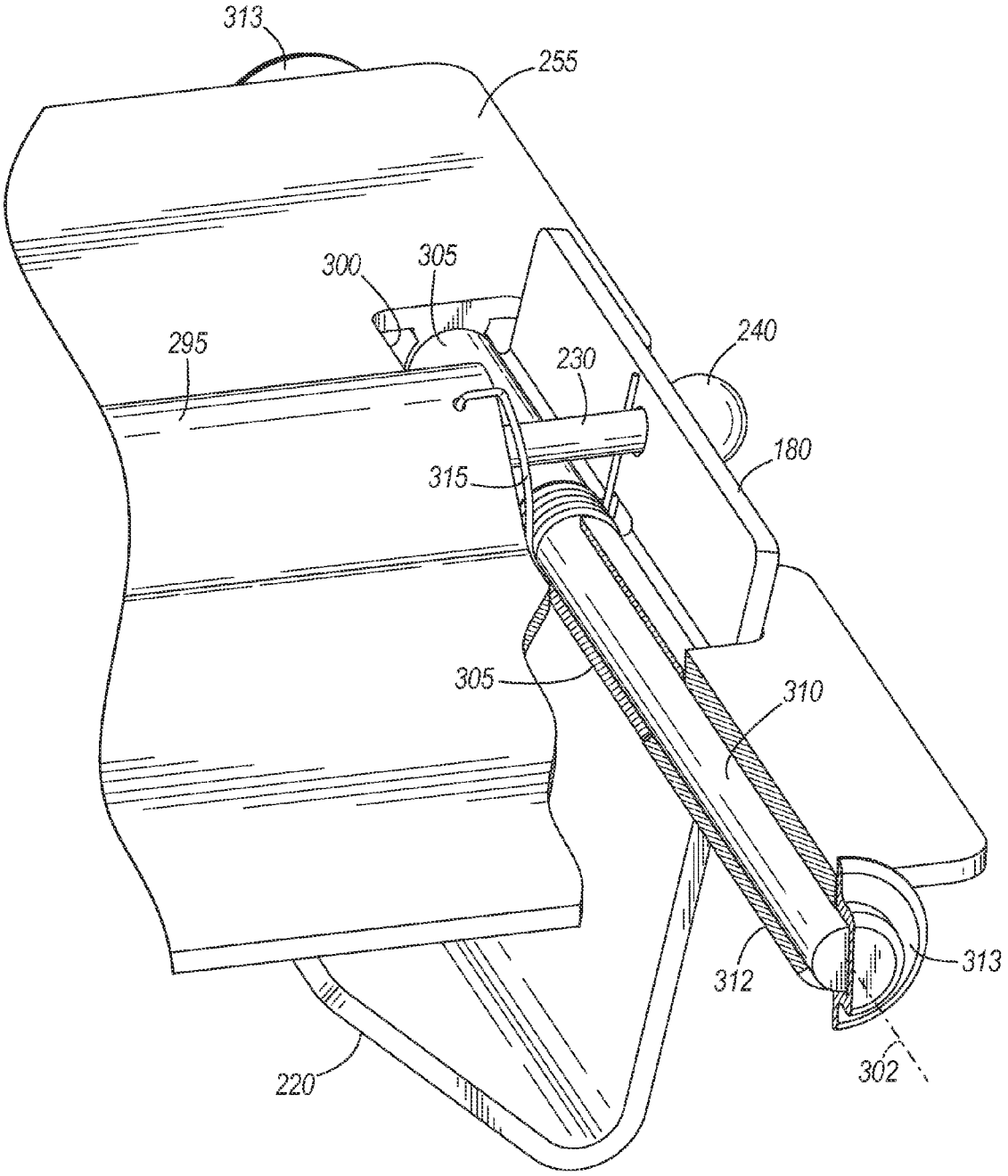
FIG. 5*a* is a perspective view from beneath of an enlarged portion of the caddy as shown in FIG. 5.

FIGS. 1 and 5 show that the frame 105 further includes a linkage support or rod 165 that extends horizontally between the side portions 142 below the handle 150. Only the ends of the rod 165 are visible in the drawings. A generally U-shaped retainer 170 has legs pivotably coupled to the rod 165 adjacent the side portions 142. The retainer is pivotable between a lower position (shown in the drawings) in which the retainer 170 wraps around three sides of the container 15 and limits forward movement of the container 15 relative to the caddy 20, and an upper position (not shown) in which the retainer 170 permits removal of the container 15 from the caddy 20.

With reference to FIGS. 1, 2 and 4, the cart 10 also includes a hands-free mechanism 175, a latch 180, a first or latch linkage 185 coupled between the hands-free mechanism 175 and the latch 180, and a second or cover linkage 190 coupled between the cover 55 and the hands-free mechanism 175.

The hands-free mechanism 175 includes a generally U-shaped foot pedal 195 with parallel side legs 196 extending in a front-to-back direction, and a front portion 197 extending between the front ends of the side legs 196. The rear ends of the side legs 196 are pivotably coupled to the caddy 20 at the axle 125 adjacent respective axle support portions 120, so that the entire foot pedal 195 is pivotable relative to the caddy 20 about a generally horizontal axis. Each of the side portions 196 has thereon a U-shaped extension 198. The extensions 198 are accessible from the sides of the caddy, and the front portion 197 is accessible from the front of the caddy, such that the foot pedal 195 is accessible from adjacent the front and both sides of the caddy 20. The foot pedal also includes (see FIG. 7) a horizontal support rod 205 located forward of the axle 125. The support rod 205 extends between and is welded to the side portions 196 to limit lateral sliding movement of the ends of the side portions 196 toward each other. Springs 200 (see FIGS. 4 and 12*a*) on opposite sides of the caddy are connected between the forward-most frame support 135 and respective extensions 198 of the foot pedal 195 to bias the foot pedal 195 to an up or normal position (FIG. 9*b*). The foot pedal is coupled to the latch linkage 185 and to the cover linkage 190 as described below.

Figure 7:
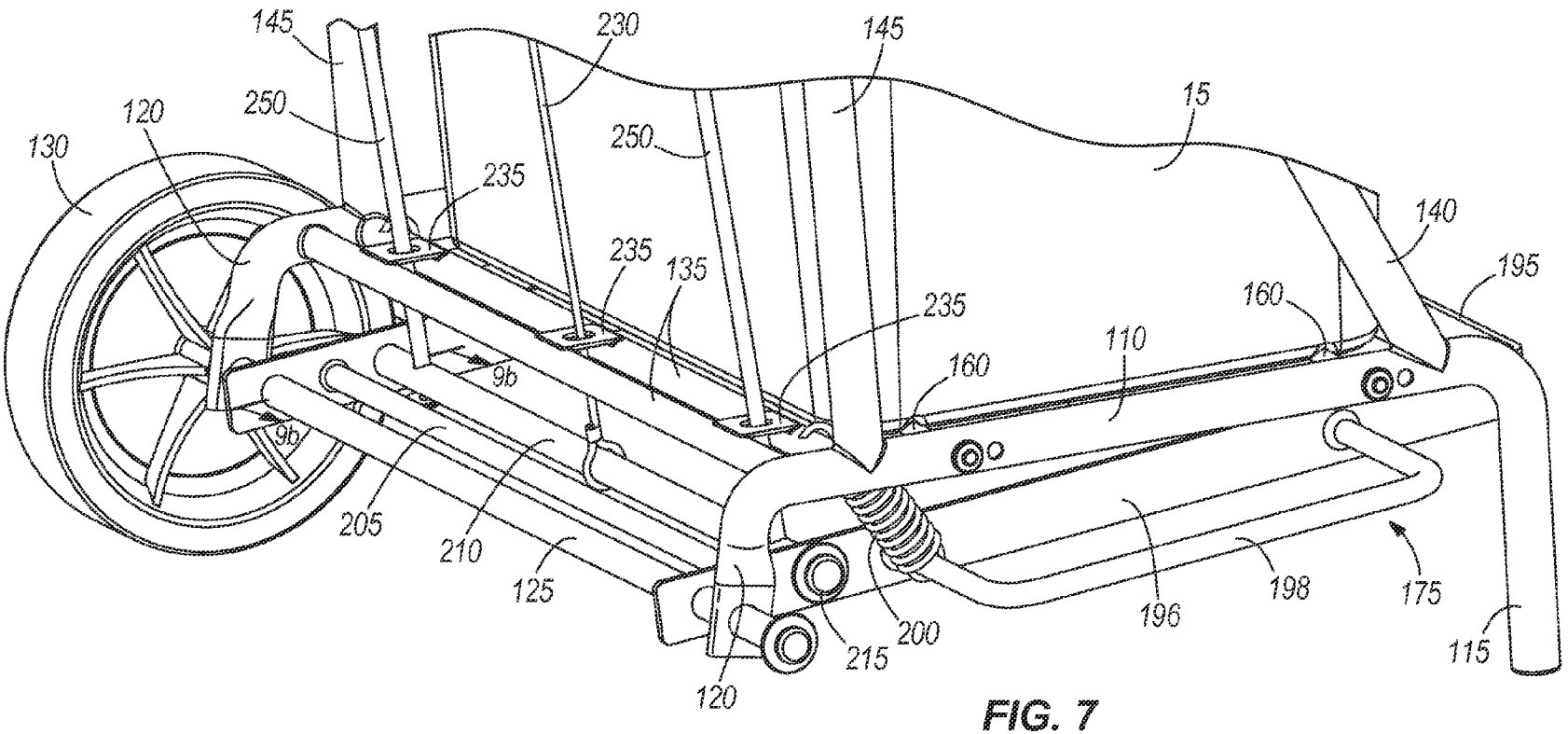
FIG. 7 is a perspective view of a lower portion of the cart showing the container and a hands-free mechanism.

FIGS. 2 and 7 show that the hands-free mechanism 175 also includes a linkage connector or actuating rod 210 located forward of the support rod 205 but adjacent the rear end of the foot pedal 195. Opposite ends of the actuating rod 210 extend through apertures (not shown) in the side portions 196, and each end of the actuating rod is attached to the respective side portion 196 by a fastener 215 (e.g., a cap fastener, a circlip, a through-bolt, a pin, etc.) that permits relative pivotal movement between the foot pedal 195 and the actuating rod 210 during operation of the hands-free mechanism 175.

The latch 180 (see FIGS. 1, 4, 5 and 5*a*) is located between the container 15 and the cover 55 to releasably hold the cover 55 in the closed position. Specifically, in the illustrated construction, the latch 180 is pivotably mounted on a portion of the cover linkage 190, as described below. In this manner, the latch 180 is coupled to the cover 55 via the cover linkage 190. The latch 180 includes an angled container engagement portion 220 that is engageable with the flange 40 of the container 15 to hold the cover 55 in the closed position. With reference to FIGS. 5 and 6, the container engagement portion 220 has therein a recess 222 and engages the underside of the flange 40 such that one of the ribs 50 extends into the recess 222. The latch 180 has a latched state (FIGS. 3*a* and 6) in which the latch 180 is engaged with the container 15 to inhibit movement of the cover 55 to the open position, and an unlatched state (FIG. 8) in which the latch 180 is disengaged from the container 15 to permit movement of the cover 55 to the open position.

The hands-free mechanism 175 is coupled to the container 15 and engaged with the cover 55 via the cover linkage 190 to move the cover 55 between the open position and the closed position. As illustrated in FIGS. 2-5*a*, the cover linkage 190 includes a tubular member 245 that surrounds and is pivotable about the rod 165, connector rods 250 that extend upward from the actuating rod 210 to the tubular member 245, and a cover plate 255 that is attached to the tubular member 245.

The tubular member 245 is actually two tube segments 246 (see FIG. 5) spaced from each other along the rod 165. As described below, the two segments 246 pivot together about the rod 165, so the tubular member 245 can be considered a unitary member. Pivot guides or tubes 260 are longitudinally disposed on respective segments 246 of the tubular member 245 adjacent the opposite ends of the tubular member 245. The pivot guides 260 pivotably attach upper ends of respective connector rods 250 to the tubular member 245. The upper ends of the connector rods 250 are bent at a ninety-degree angle and extend into respective pivot guides 260 such that the ends of the rods 250 are pivotable relative to the guides 260.

Figure 12A:
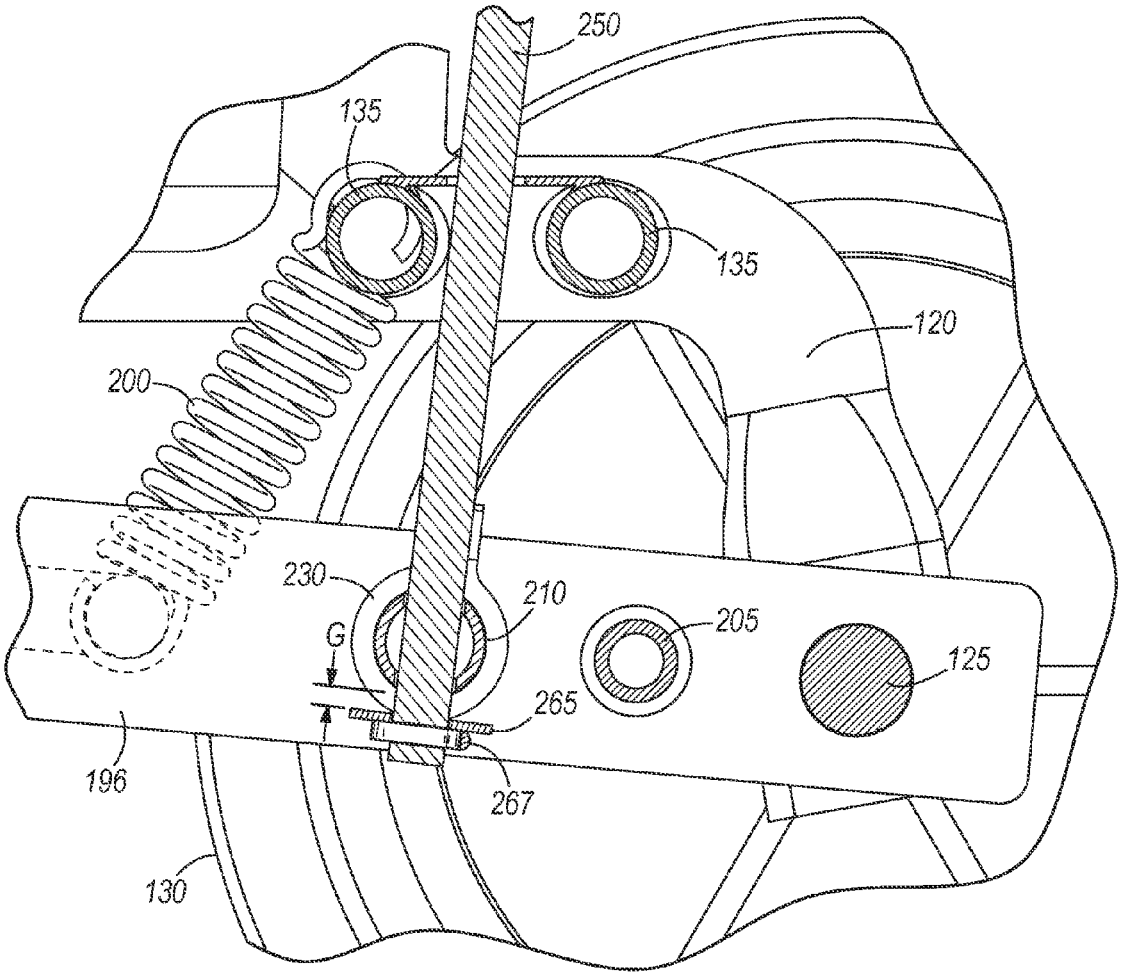
FIG. 12*a* is a section view taken along line 12*a*-12*a* of FIG. 2 with the foot pedal in the normal position and the cover in the closed position.
Figure 12B:
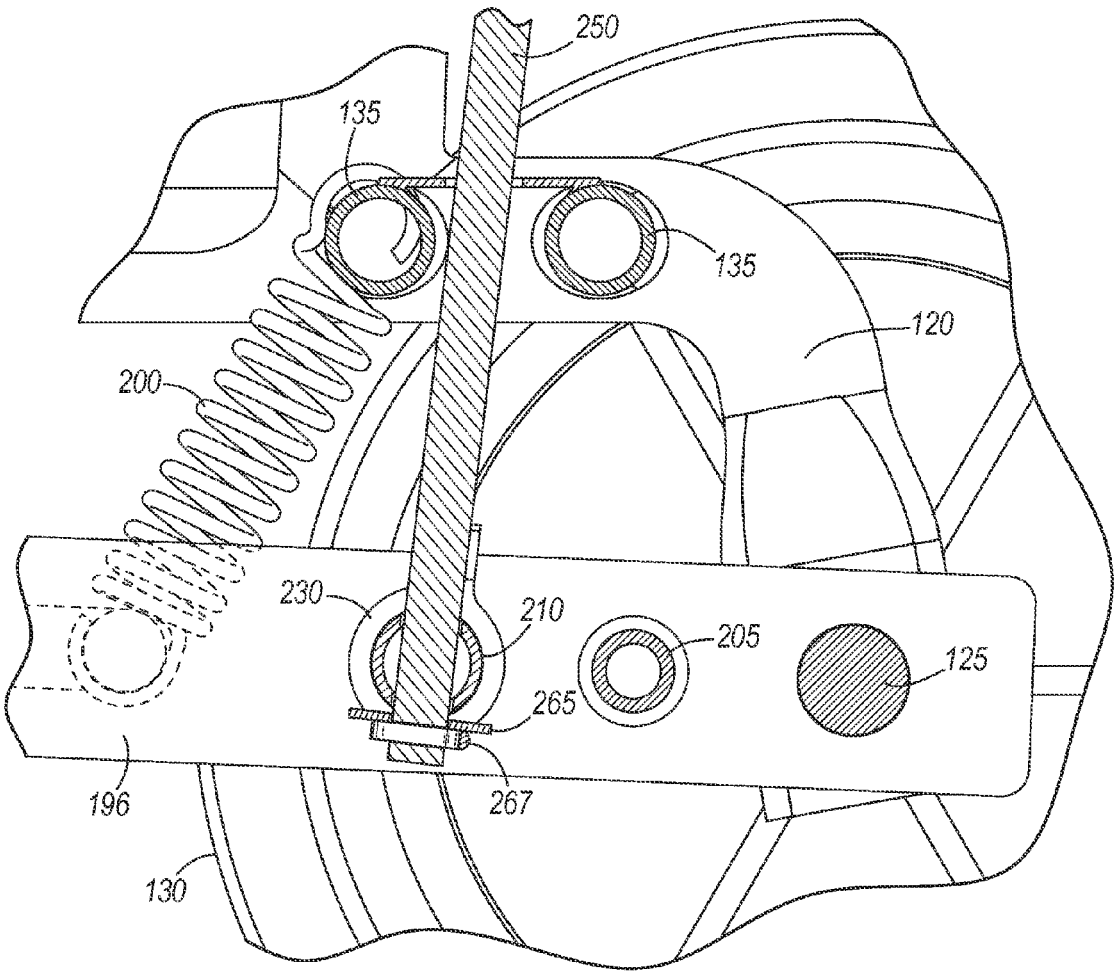
FIG. 12*b* is a view similar to FIG. 12*a* with the foot pedal in the intermediate position and the cover in the closed position.

With reference to FIG. 7, the connector rods 250 pass through apertures in guide plates 235, which are mounted on and extend between the frame supports 135. The lower ends of the connector rods 250 extend through the actuating rod 210, as best shown in FIGS. 12*a* and 12*b*. A washer 265 is coupled to the lower end of each of the connector rods 250 so that each washer 265 is spaced (see FIG. 12*a*) a small distance or gap G (e.g., 0.075 inches, 0.10 inches, etc.) below the actuating rod 210 when the foot pedal 195 is in the normal position and the cover 15 is closed. The washers 265 are held on the rods 250 with pins 267, although lock nuts or other suitable means can be used. When the foot pedal 195 is pushed down, the actuating rod 210 initially moves relative to the rods 250, which remain stationary, until the gap between the connector 210 and the washers 265 is closed. When the gap is closed, the actuating rod 210 engages the washers 265, and subsequent downward movement of the foot pedal and the actuating rod 210 pushes on the washers 265 and causes downward movement of the rods 250. There is thus a lost-motion connection between the actuating rod 210 and the connector rods 250. As further described below, downward movement of the rods 250 opens the cover 55. Devices other than washers (cap fasteners, pins, through-bolts, etc.) can be used on the lower ends of the rods 250.

As illustrated, the rearward end of the plate 255 is welded or otherwise connected to each of the segments 246 of the tubular member 245 so that the two segments pivot together and so that the plate 255 pivots with the tubular member 245 about a horizontal axis 270 (FIG. 4) extending through the rod 165. With reference to FIGS. 3*a*, 3*b*, and 5, the plate 255 extends over the cover 55 adjacent the recessed sections 80 such that the plate 255 is partially recessed relative to the cover 55.

The plate 255 has (see FIGS. 3*a* and 3*b*) a rear engagement portion 275 that is engaged with the rear attachment section 85, and a front engagement portion 280 that is engaged with the front attachment section 90. The engagement portions 275, 280 are located on the underside of the plate 255 and cooperate with each other to attach the cover 55 to the cover linkage 190 so that the cover 55 can be moved between the open position and the closed position via the foot pedal 195. The rear engagement portion 275 extends laterally across the underside of the plate 255 near the rearward end of the plate 255 and has (see FIG. 3*b*) a central indentation or depression 285 that frictionally engages the projection 100 of the rear attachment section 85. The rear engagement portion 275 also extends partially into the elongated groove 95 of the rear attachment section 85. The rear engagement portion 275 can be snapped downward into this position, as further described below. As shown in FIG. 3*a*, the front engagement portion 280 is defined by a protrusion 290 extending laterally across the underside of the plate 255 near the forward end of the plate. The protrusion 290 extends into the elongated groove 95 of the front attachment section 90 to hold the plate 255 in engagement with the cover 255 adjacent the forward end of the cover. The plate 255 must be pushed forward relative to the cover 55 to insert the protrusion 290 into the groove 95. Other mechanisms for attaching the plate 255 to the cover 55 are also possible and considered herein. The plate 255 is attached to the cover 55 such that pivotal movement of the tubular member 245 and the plate 255 in response to downward movement of the rods 250 pivots the cover 55 toward the open position.

With continued reference to FIGS. 3*a*, 3*b*, 5, 6, and 8, the plate 255 also includes a raised central rib 295 that extends longitudinally along the center of the plate 255 in the front-to-back direction. The distal or front end of the plate 255 includes (see FIG. 5*a*) a recess or pocket 300 through which the latch 180 extends. The latch 180 is pivotable relative to the plate 255 about a horizontal axis 302, and the front and rear walls defining the recess 300 limit the pivotal movement of the latch. The latch has fixed thereto (e.g., by welding) a pair of cylindrical sleeves 305 spaced from each other along the axis 302. A pivot pin 310 extends through the sleeves 305, and the sleeves 305 and the latch 180 are pivotable about the pin 310. The opposite end portions of the pin 310 are pivotably received in respective cylindrical sleeves 312 fixed (e.g., by welding) to the underside of the plate 255. The opposite ends of the pin 310 have thereon locking caps 313 that prevent the pin 310 from coming out of the sleeves 312. A torsion spring 315 surrounds the pin 310 in the space between the sleeves 305. The spring 315 is coupled to the plate 255 and to the latch 180 so as to bias the latch to its latched state.

The latch linkage 185 includes (see FIGS. 3*b* and 5) a tubular cable guide 225 that surrounds the rod 165 between the segments 246 of the tubular member 245. The cable guide 225 is preferably made of a low-friction material. The latch linkage 185 also includes a cable 230 that extends over the cable guide 225. The cable 230 is operatively coupled to the foot pedal 195 via attachment to the actuating rod 210 by any suitable means (e.g., looped or tied around the actuating rod 210). The attachment is such that downward movement of the connector 210 when the foot pedal is in the normal position and the cover 55 is in the closed position immediately causes downward movement of the cable 230. The cable 230 is routed upward from the actuating rod 210 through a guide plate 235 (FIG. 7) and over the cable guide 225 to the latch 180. The rib 295 on the plate 255 accommodates passage of the cable 230 from the pulley to the latch 180. As illustrated, the cable 230 extends through an opening in the latch 180 and has an enlarged end portion 240 that pulls rearward on the upper end of the latch 180 in response to downward movement of the foot pedal 195.

The latch 180 is movable between a first position (see FIG. 6) corresponding to the latched state and a second position (see FIG. 8) corresponding to the unlatched state. The foot pedal 195 is movable downward a first distance D1 (FIG. 10*b*) from the normal position to a middle or intermediate position (FIGS. 10*b* and 12*b*) to pull on the cable 230 and move the latch 180 from the first position to the second position (unlatched). When the foot pedal reaches the intermediate position, the actuating rod 210 engages the washers 265 so that further downward movement of the foot pedal will pull down on the rods 250. The foot pedal 195 is movable downward an additional or second distance D2 (FIG. 11*b*) beyond the first distance and beyond the intermediate position to a lowermost or down or open position. During movement from the intermediate position to the lowermost position, the foot pedal engages the latch linkage 185 and the cover linkage 190 (i.e., pulls down on the rods 250) to hold the latch 180 in the unlatched state and to move the cover 55 toward the open position. The cover 55 is in the open or up position when the foot pedal 195 is moved from the normal position to the lowermost position. The second distance is in the same direction as the first distance. While in the illustrated construction the second distance is greater than the first distance, this need not be the case.

The retainer 170 is pivoted upward prior to placing the container 15 on the caddy 20. The cover 55 can be attached to the plate 255 before or after the container 15 is placed on the caddy 20. The cover 55 is attached to the plate 255 by inserting the front engagement portion 280 into the front attachment section 90, i.e., by inserting the protrusion 290 into the groove 95. The rear engagement portion 275 is then snapped or pushed into engagement with the rear attachment section 85, i.e., with the projection 100 of the rear attachment section 85. The cover 55 is thus releasably held in engagement with the cover linkage 190 via the plate 255 so that the cover 55 can be opened and closed in response to movement of the cover linkage 190.

Figure 10A:
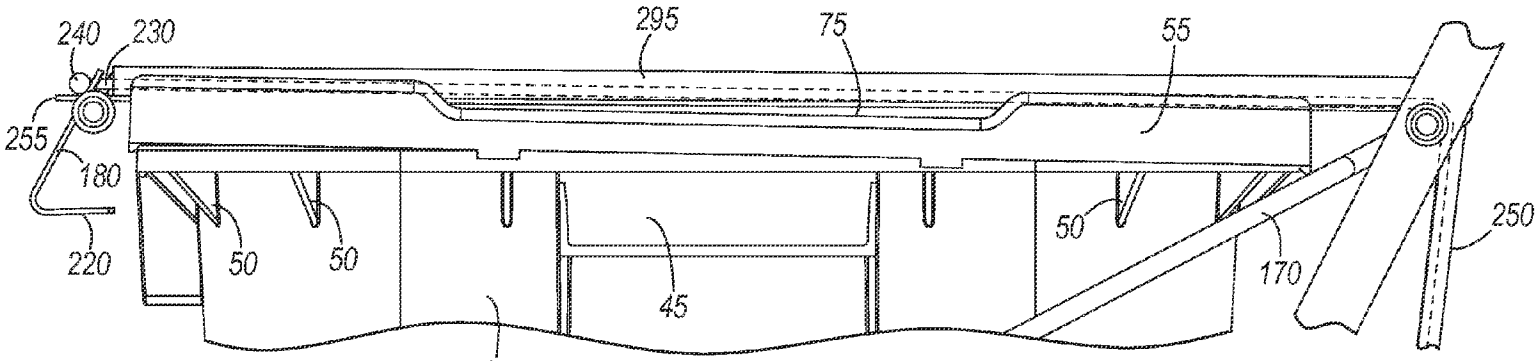
FIG. 10*a* is a view similar to FIG. 9*a* showing the latch in the unlatched state and the cover in the closed position.
Figure 10B:
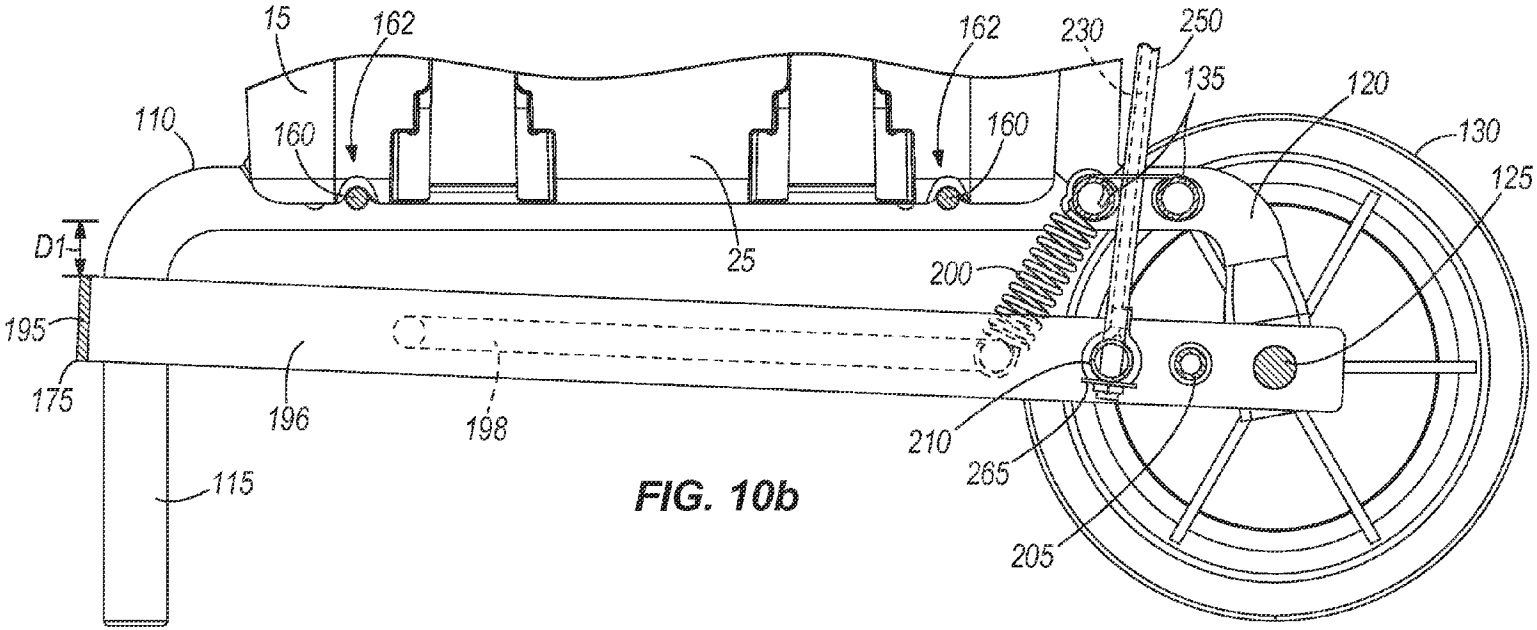
FIG. 10*b* is a view similar to FIG. 9*b* with the foot pedal pushed down to an intermediate position.

FIGS. 1, 3*a*, 3*b*, 6, 9*a*, and 9*b* show the container 15 supported on the caddy 20 with the cover 55 in the closed position, the foot pedal 195 in the normal position, and the latch 180 in the latched state. The latch 180 holds the cover 55 in the closed position when the foot pedal 195 is in the normal position. Technically speaking, the latch 180 cooperates with the plate 255 to hold the cover in the closed position, but once the latch is released (i.e., in the unlatched state), a person can lift the front end of the cover to open the cover. FIGS. 8, 10*a*, and 10*b* show the foot pedal 195 moved or depressed the first distance D1 to the middle or intermediate position to vary the latch 180 from the latched state (FIG. 6) to the unlatched state (FIG. 8). When the foot pedal 195 is moved the first distance, the following happen: (1) the actuating rod 210 moves relative to the connector rods 250 such that the actuating rod 210 just engages the washers 265 attached to the connector rods 250; (2) the actuating rod 210 pulls on the cable 230 so that the latch 180 pivots to disengage the latch 180 from the container 15; (3) the springs 200 are pulled or extended a relatively small amount against their bias; and (4) the cover 55 remains in the closed position due to the lost motion between the bottom of the actuating rod 210 and the connector rods 250.

Figure 11A:
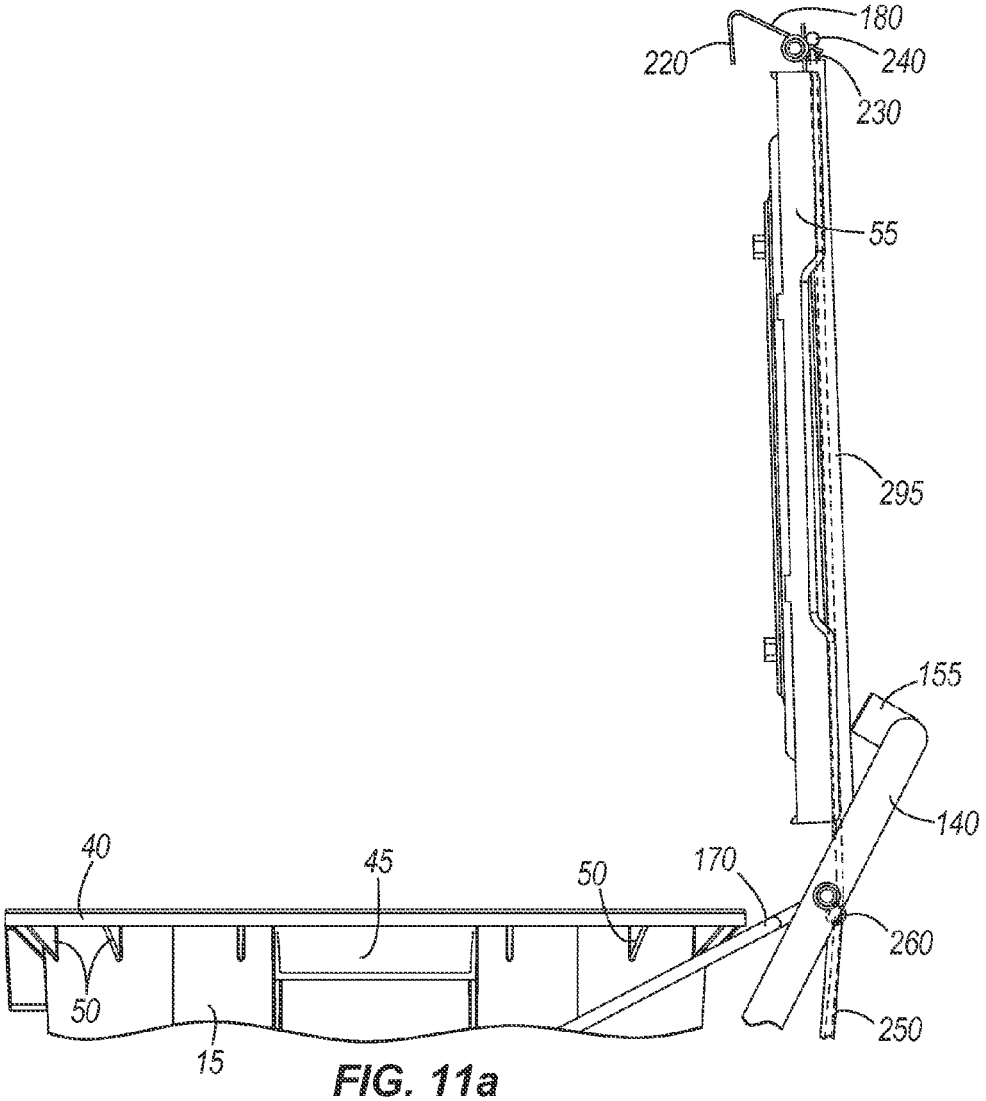
FIG. 11*a* is a view similar to FIG. 9*a* showing the latch in the unlatched state and the cover in an open position.
Figure 11B:
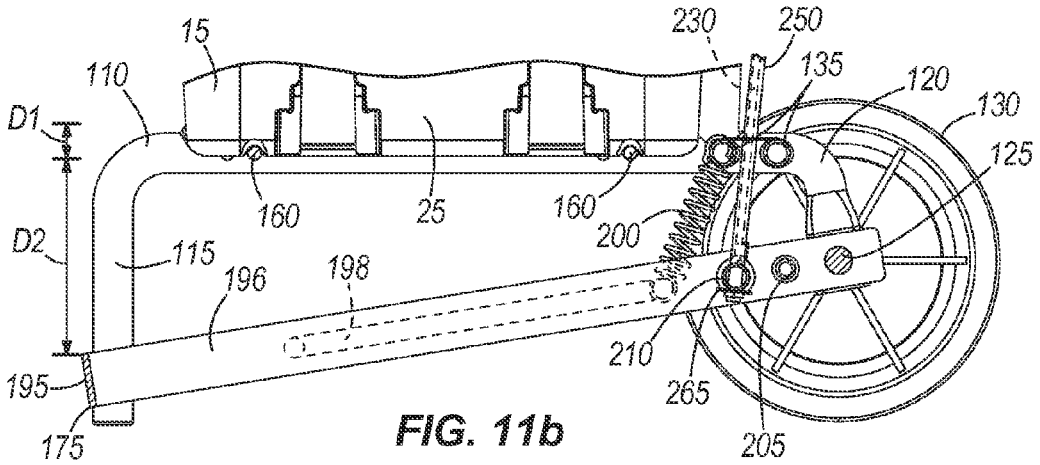
FIG. 11*b* is a view similar to FIG. 9*b* with the foot pedal pushed down to a lowermost position.

FIGS. 11*a* and 11*b* show the foot pedal 195 moved or depressed the second distance to the down position. When the foot pedal 195 is moved the second distance, beyond the first distance, the following happen: (1) downward movement of the actuating rod 210 keeps the cable 230 taut so that the latch 180 is held or remains in the unlatched state; (2) the actuating rod 210 pulls the connector rods 250 downward due to engagement of the actuating rod 210 with the washers 265, and downward movement of the connector rods 250 pulls on the pivot guides 260, which pivots the tubular member 245 and the plate 255 about the axis 270, thereby moving the cover 55 to the open position; and (3) the springs 200 are pulled or extended a relatively large amount against their bias.

With reference to FIG. 11*a*, the plate 255 hits the stop 155 when the cover 55 is in the open position. As illustrated, the cover 55 defines an angle of less than ninety degrees relative to the horizontal plane defined by the flange 40. As such, when the cover is in the open position, gravity biases the cover toward the closed position, but the cover will remain up as long as the foot pedal is depressed. Also, the latch 180 remains in the unlatched state as long as the foot pedal 195 is depressed.

Upon release of the foot pedal 195, the springs 200 pull the foot pedal 195 upward to the normal position. Movement of the foot pedal 195 and the actuating rod 210 back to the normal position removes the downward force on the washers 265 so that the connector rods 250 are free to move upward. Once the connector rods are no longer holding the cover 55 up, gravity causes the cover to drop to the closed position. Normally, an operator will lift his or her foot slowly so that the foot pedal 195 moves up slowly and the cover closes slowly. The latch 180 remains in the unlatched state until the cover 55 reaches the closed position. At that point the tension on the cable 230 is removed, which removes the force on the latch 180, and the latch 180 returns to the latched state due to the bias provided by the spring 315.

In alternative embodiments, the cover 55 can define an angle of ninety degrees or more in the open position, but then a force other than gravity, such as springs biasing the rods 250 upward, would be needed to close the cover.

The hands-free mechanism 175 disengages the latch 180 from the container 15 to permit movement of the cover 55 to the open position. The hands-free mechanism 175, the latch linkage 185, and the cover linkage 190 cooperate with each other to sequentially vary the latch 180 to the unlatched state and open the cover 55. The sequential operation of the latch linkage 185 and the cover linkage 190 minimizes the steps needed to move the cover 55 from the closed position to the open position. Stated another way, the hands-free mechanism 175, the latch linkage 185, and the cover linkage 190 disengage the latch 180 from the cover 55 via operation of the same foot pedal 195 that opens the cover 55.

The retainer 170 and the frame 105 hold the container 15 on the caddy 20. Absent a force on the foot pedal 195, the bias of the latch 180 to the latched state holds the cover 55 in the closed position so that in the event the cart 10 is tipped over, the cover 55 remains in the closed position and the contents of the container 15 remain within the interior space 35. Movement of the foot pedal 195 the first distance D1 from the normal position engages the latch linkage 185 without engaging the cover linkage 190 to vary the latch 180 to the unlatched state. The latch 180 is temporarily moved against the bias of the spring 315 by the foot pedal 195 to permit movement of the cover 55 to the open position when the foot pedal 195 is moved the additional second distance D2. The latch 180 is held against the bias by the hands-free mechanism 175 and the latch linkage 185 when the hands-free mechanism 175 and the cover linkage 190 are manipulated to move the cover 55 between the closed position and the open position. That is, the latch 180 is held in the unlatched state whenever the foot pedal 195 is not in the normal position.

FIGS. 13-21*b* show another cart 410 including the container 15 and a caddy 420 for supporting the container 15. Except as described below, the caddy 420 is the same as the caddy 20, and common elements are given the same reference numerals. The caddy 420 includes a frame 425 that has a primary upright frame member 430, secondary upright frame members 435, and base frame members 440 extending between the primary upright frame member 430 and the secondary upright frame members 435. The frame member 430 includes side portions 445 that extend upward from the axle 125, and a handle 450 that extends horizontally between the upper ends of the side portions 445. A U-shaped cradle 455 is coupled to the container supports 160 of the frame 425 for holding the container 15 in place on the caddy 420.

The lower ends of the connector rods 250 extend through the actuating rod 210, and a nut 457 is coupled to the lower end of each of the connector rods 250 so that each nut 457 is spaced (see FIGS. 12*a* and 19*b*) a small distance or gap G (e.g., 0.075 inches, 0.10 inches, etc.) below the actuating rod 210 when the foot pedal 195 is in the normal position and the cover 15 is closed. When the foot pedal 195 is pushed down, the actuating rod 210 initially moves relative to the rods 250, which remain stationary, until the gap between the connector 210 and the nuts 457 is closed. When the gap is closed, the actuating rod 210 engages the nuts 457, and subsequent downward movement of the foot pedal and the actuating rod 210 pushes on the nuts 457 and causes downward movement of the rods 250. There is thus a lost-motion connection between the actuating rod 210 and the connector rods 250. As further described below, downward movement of the rods 250 opens the cover 55. Devices other than nuts (e.g., washers, cap fasteners, pins, through-bolts, etc.) can be used on the lower ends of the rods 250.

Figure 13:
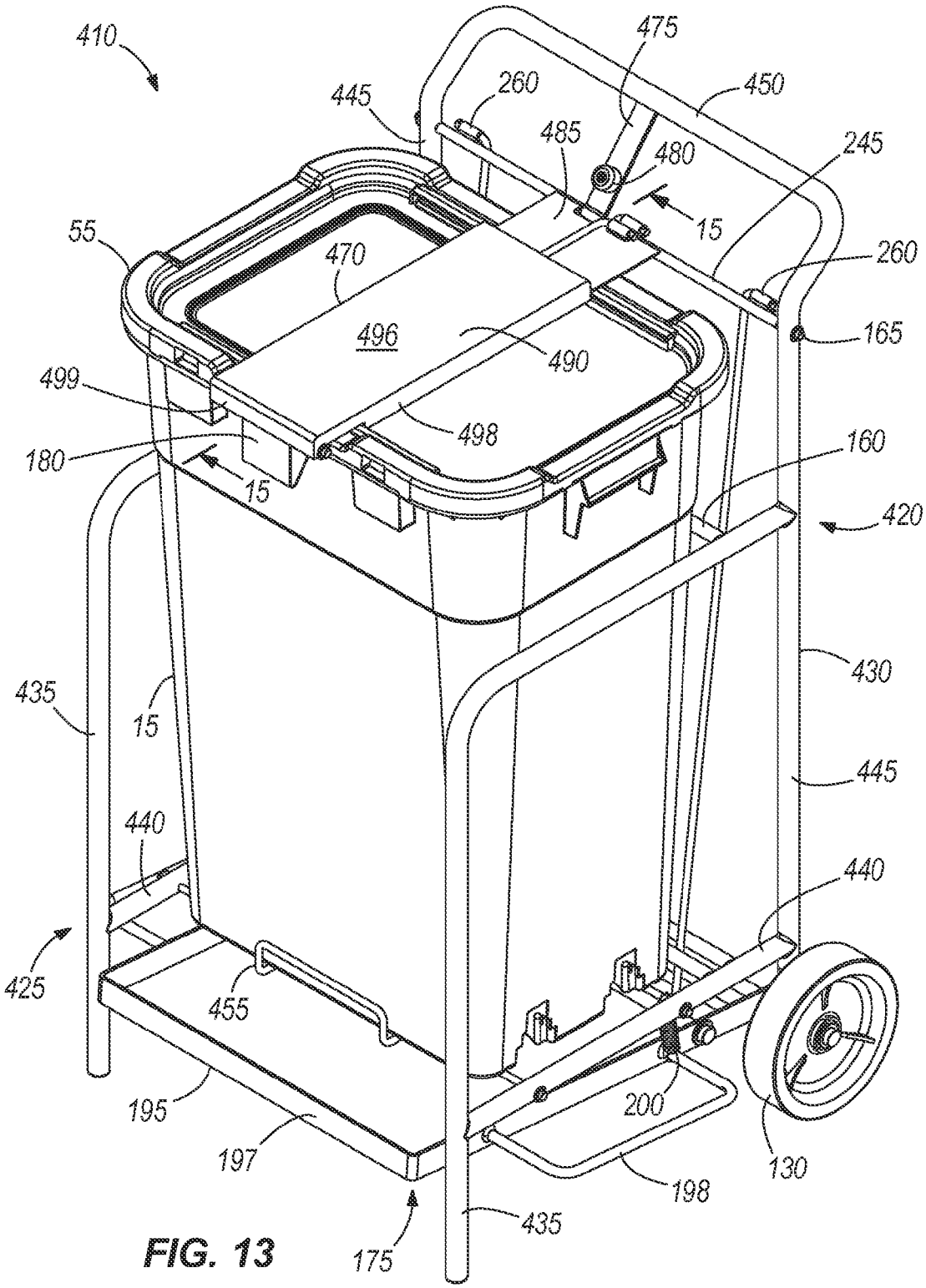
FIG. 13 is a perspective view of another cart including the container, the latch, and a caddy supporting the container of FIG. 1.
Figure 14:
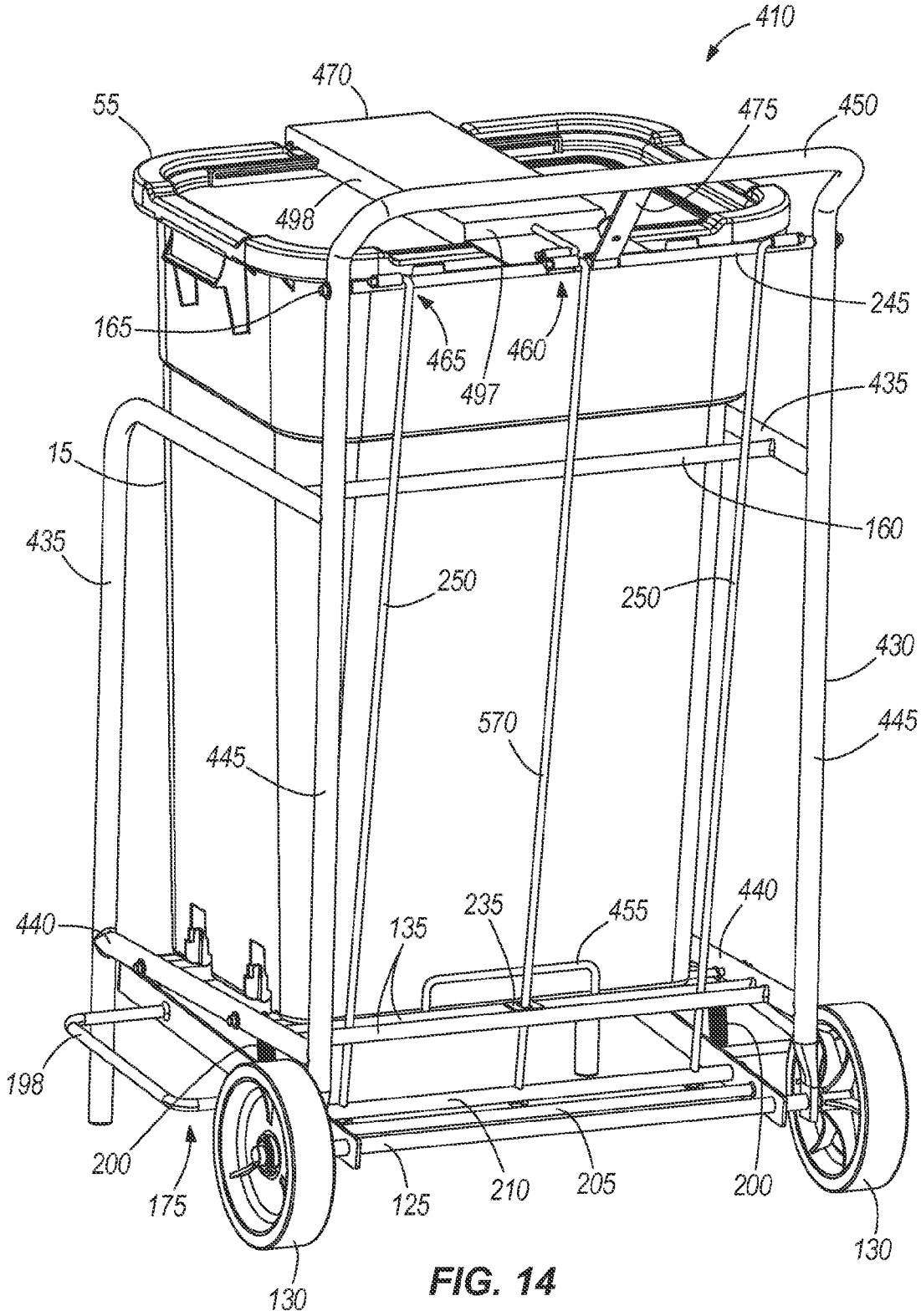
FIG. 14 is another perspective view of the cart of FIG. 13 illustrating a first linkage operatively coupled to the latch and a second linkage operatively engaged with the cover for the container.
Figure 18:
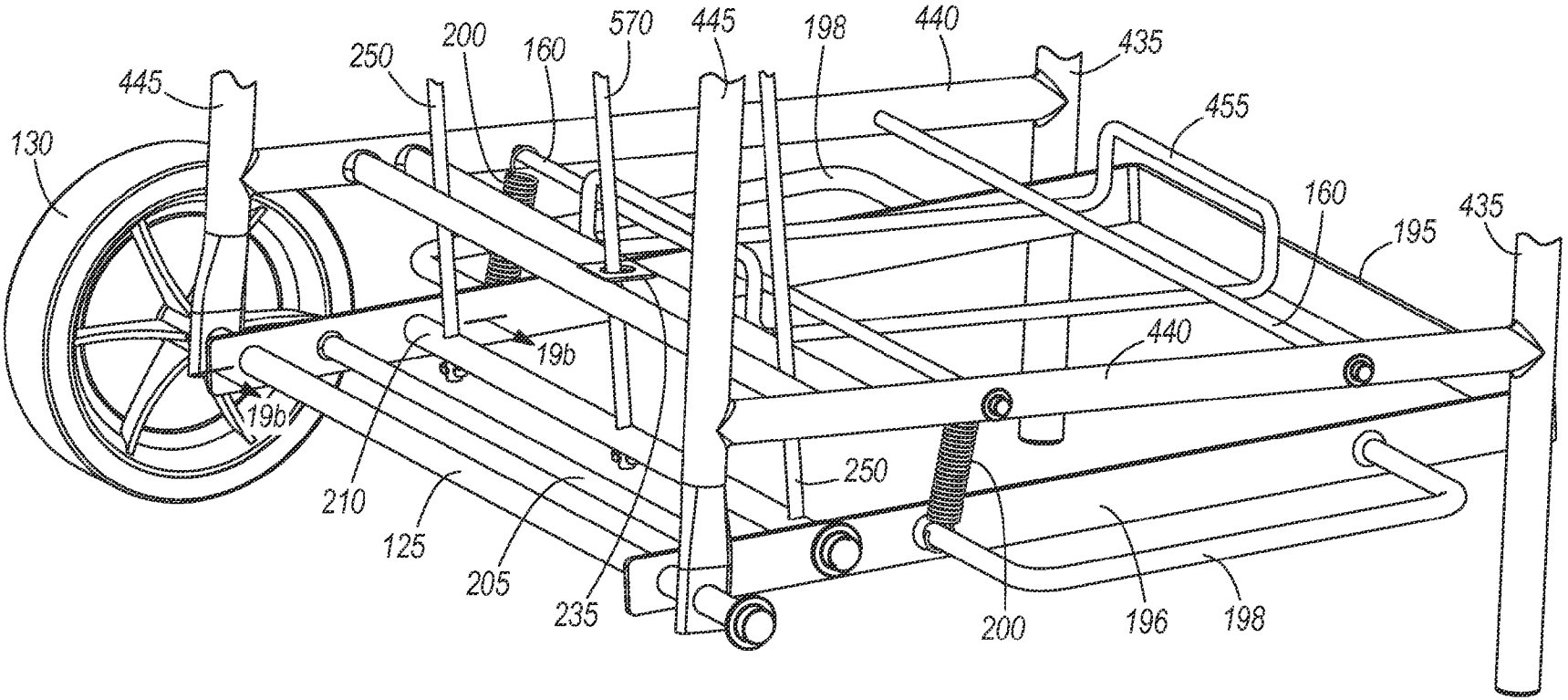
FIG. 18 is a perspective view of a lower portion of the caddy showing the hands-free mechanism.
Figure 19A:
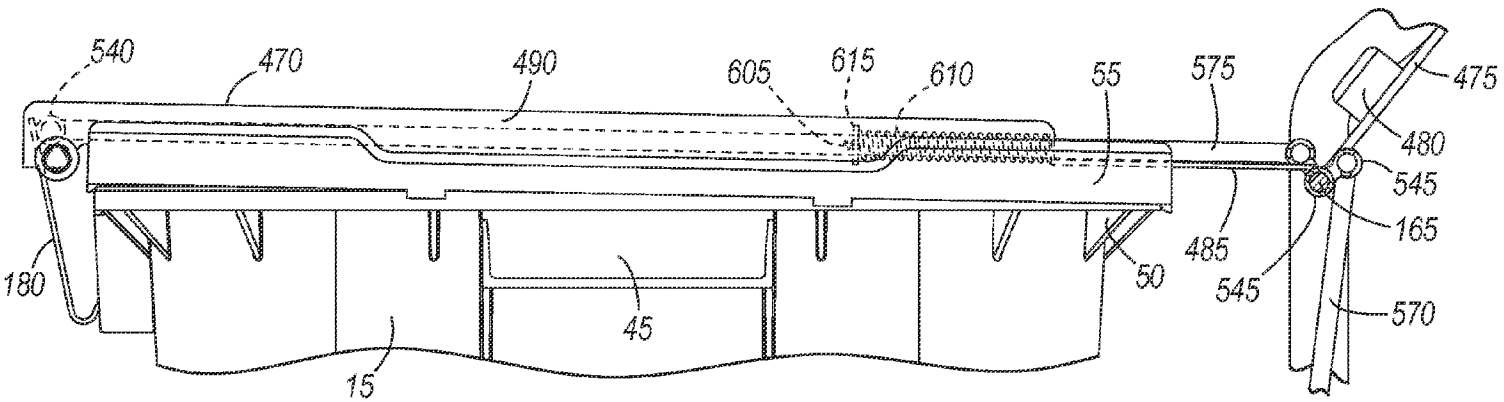
FIG. 19*a* is a side view of the upper portion of the cart showing the latch in the latched state and the cover in a closed position.
Figure 19B:
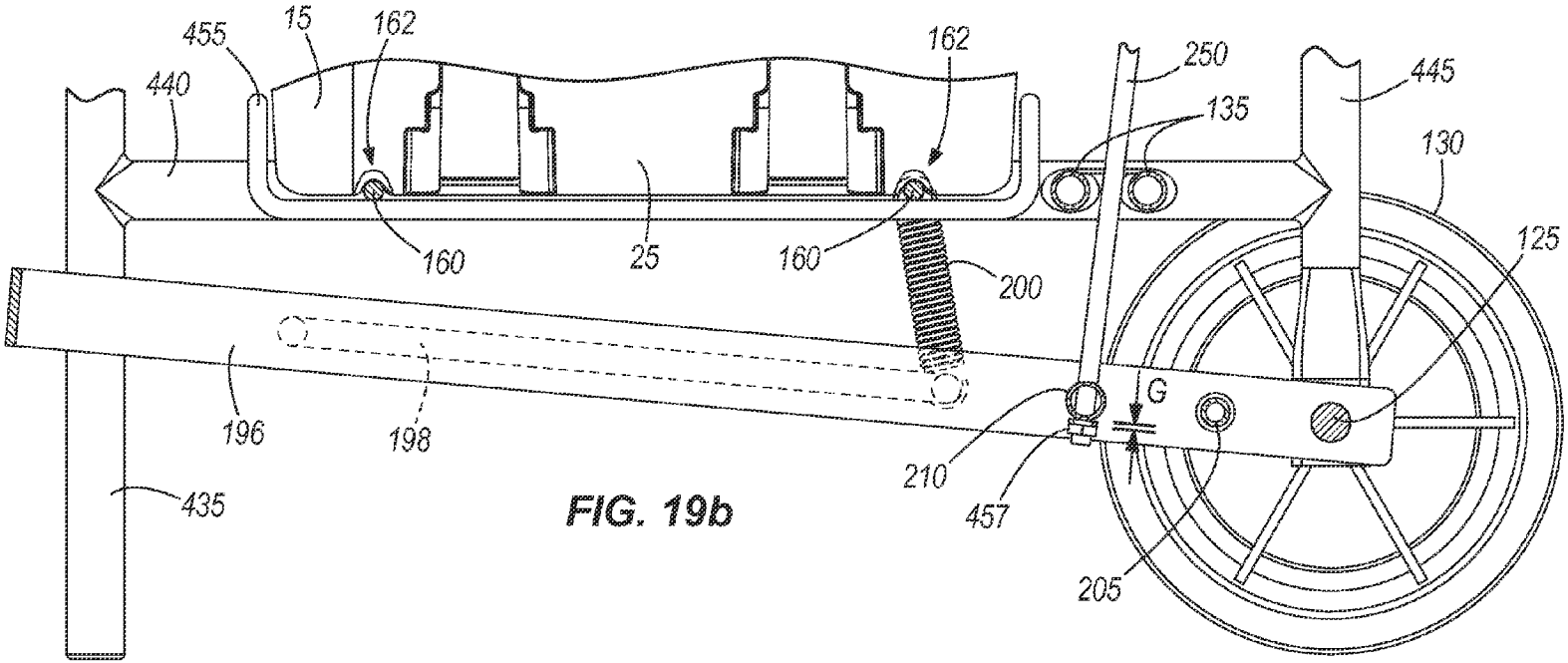
FIG. 19*b* is a section view taken along line 19*b*-19*b* of FIG. 14 showing the lower portion of the cart with a foot pedal in a normal or upper position.
Figure 20A:
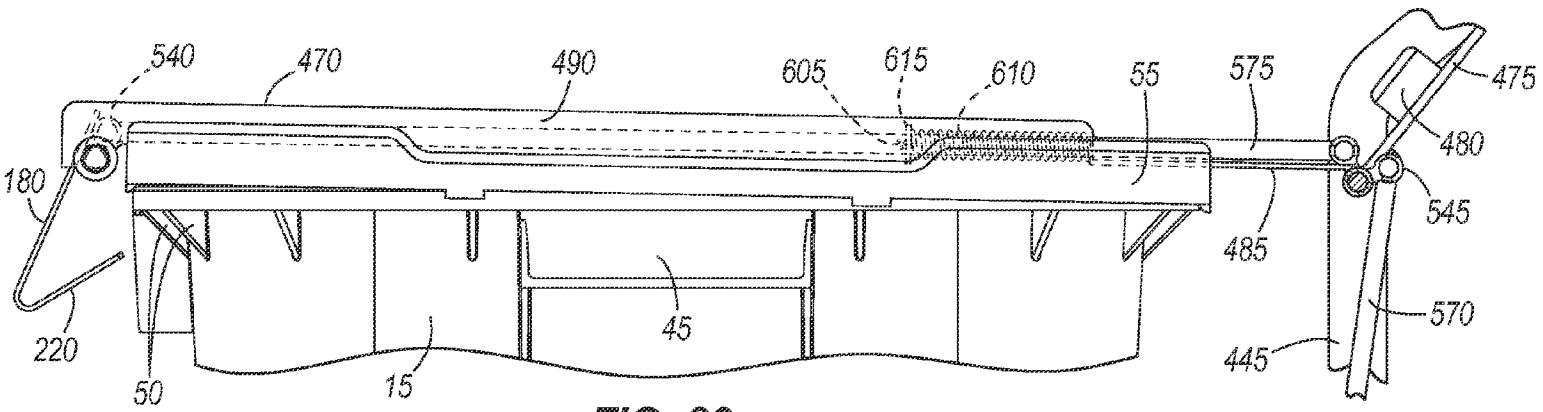
FIG. 20*a* is a view similar to FIG. 19*a* showing the latch in the unlatched state and the cover in the closed position.
Figure 20B:
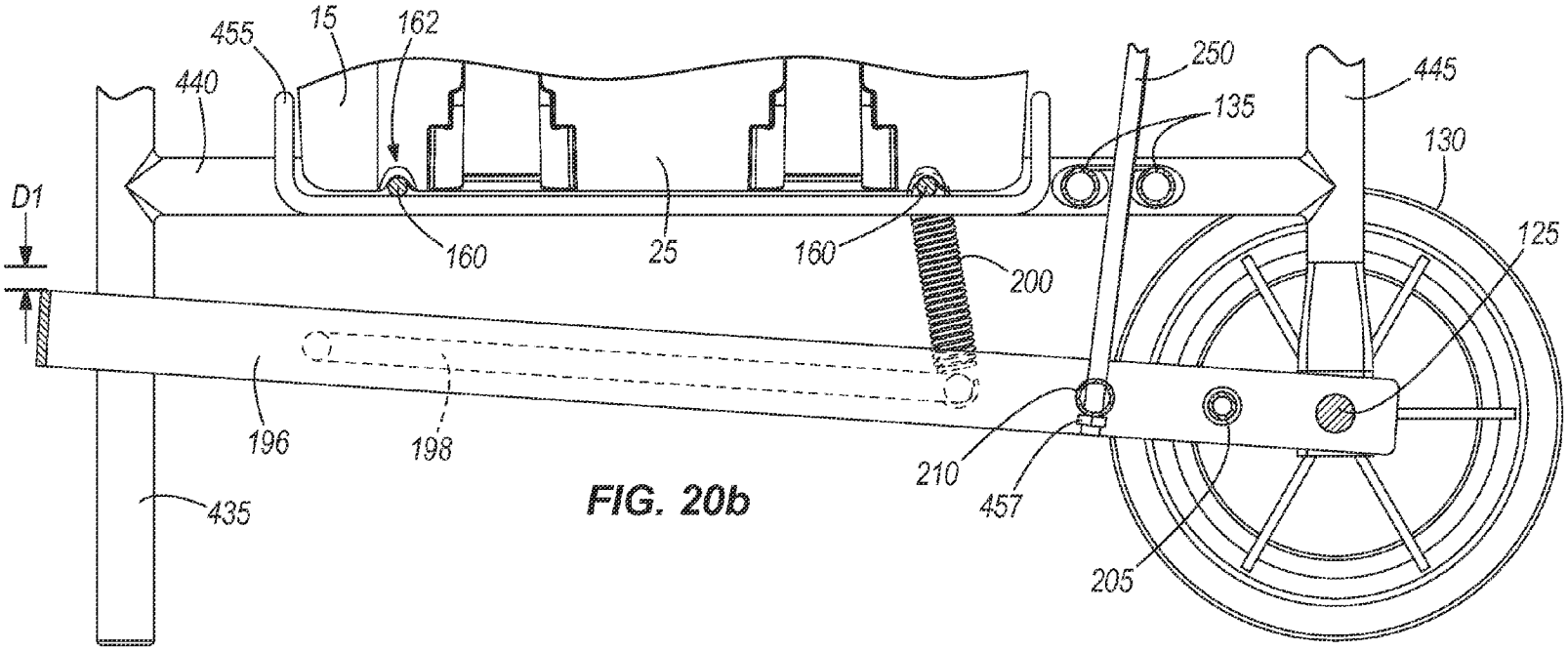
FIG. 20*b* is a view similar to FIG. 19*b* with the foot pedal pushed down to an intermediate position.

With reference to FIGS. 13, 14, and 18, the cart 410 also includes the hands-free mechanism 175, the latch 180, a first or latch linkage 460 coupled between the hands-free mechanism 175 and the latch 180, and a second or cover linkage 465 coupled between the cover 55 and the hands-free mechanism 175. The springs 200 are located on opposite sides 498 of the caddy 420 and are connected between the rearward-most container support 160 and respective extensions 198 of the foot pedal 195 to bias the foot pedal 195 to an up or normal position (FIG. 19*b*). The foot pedal 195 is coupled to the latch linkage 460 and to the cover linkage 465 as described below.

The latch 180 (see FIGS. 1, 4, 5 and 5*a*) is located between the container 15 and the cover 55 to releasably hold the cover 55 in the closed position. Specifically, the latch 180 is pivotably mounted on a portion of the cover linkage 465, as described below. In this manner, the latch 180 is coupled to the cover 55 via the cover linkage 465. The latch 180 has a latched state (FIGS. 15*a* and 19*a*) in which the latch 180 is engaged with the container 15 to inhibit movement of the cover 55 to the open position, and an unlatched state (FIG. 20*a*) in which the latch 180 is disengaged from the container 15 to permit movement of the cover 55 to the open position.

The hands-free mechanism 175 is coupled to the container 15 and engaged with the cover 55 via the cover linkage 465 to move the cover 55 between the open position and the closed position. As illustrated in FIGS. 14, 15*b*, 16, and 17, the cover linkage 465 includes the tubular member 245 that surrounds and is pivotable about the rod 165. The cover linkage 465 also includes the connector rods 250 that extend upward from the actuating rod 210 to the tubular member 245, and a cover plate 470 that is attached to the tubular member 245. A connector bar 475 extends between the handle 450 and the tubular member 245 to support a protrusion or stop 480 that limits pivotal movement of the cover 55, as further described below. The lower end of the connector bar 475 is received on the tubular member 245 so that the tubular member 245 can rotate relative to the connector bar 475.

Figure 16:
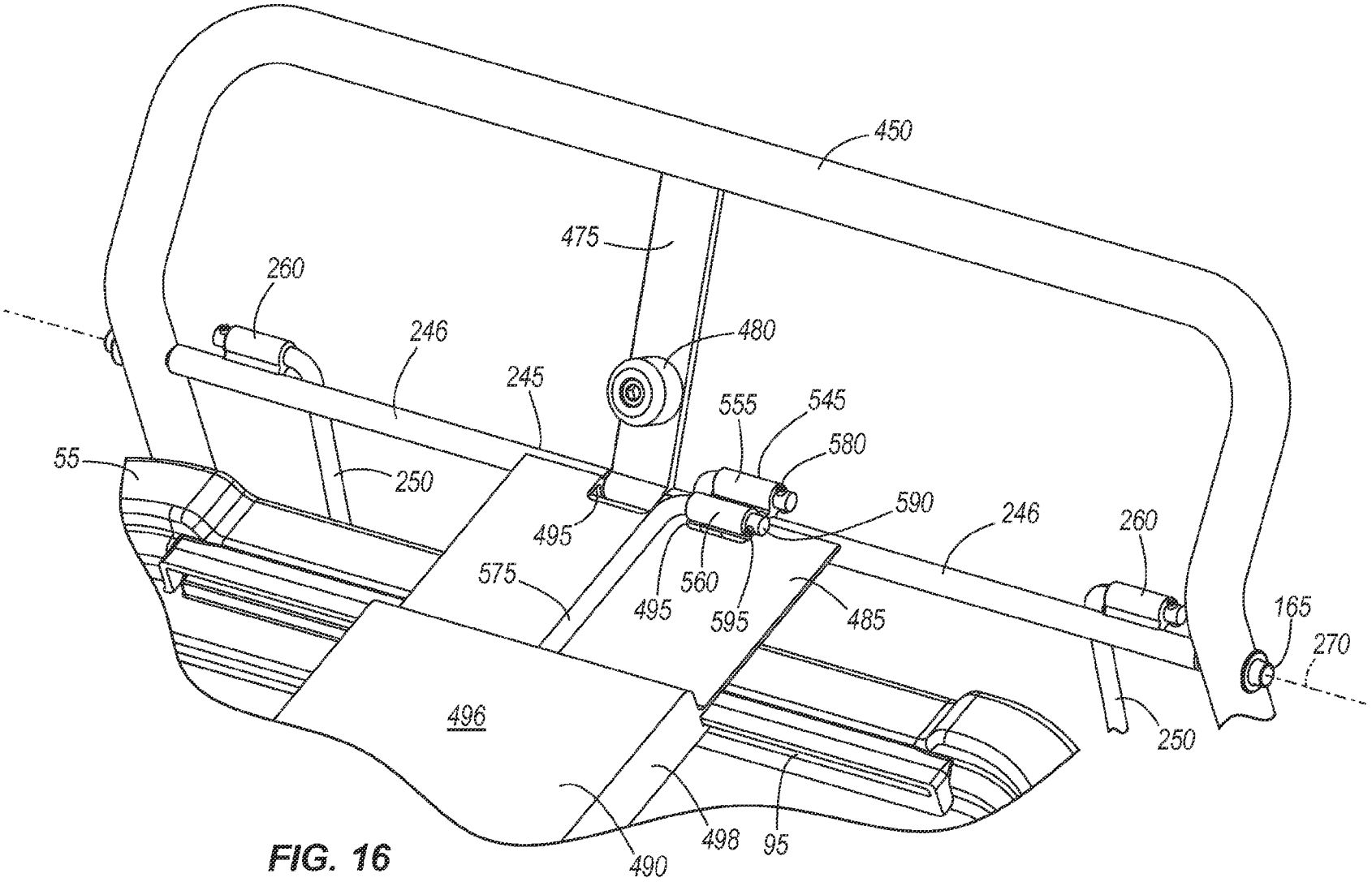
FIG. 16 is a perspective view of an upper rear portion of the caddy.

As illustrated, the cover plate 470 has a flat rearward portion 485 and a box-shaped forward portion 490. The rearward portion 485 of the cover plate 470 is welded or otherwise connected to each of the segments 246 of the tubular member 245 so that the two segments 246 pivot together and so that the plate 470 pivots with the tubular member 245 about the horizontal axis 270 (FIG. 17) extending through the rod 165. As illustrated in FIG. 16, the cover plate 470 has recessed areas 495 to avoid interfering with the connection between the tubular member 245 and the connector bar 475 and between the tubular member 245 and the latch linkage 460, as described below. With reference to FIGS. 13 and 14, the cover plate 470 extends over the cover 55 adjacent the recessed sections 80 such that the plate 470 is partially recessed relative to the cover 55.

Figure 17:
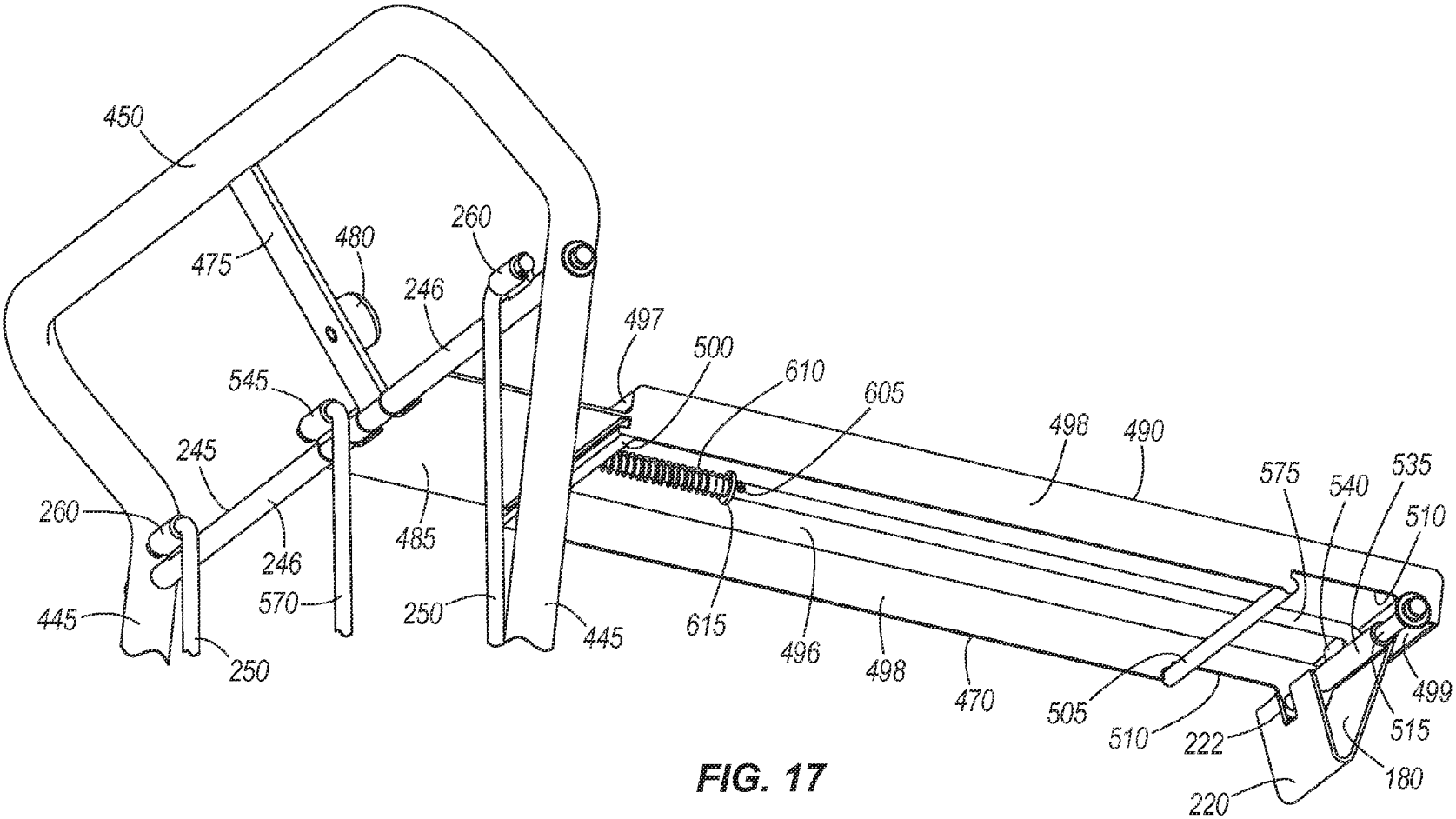
FIG. 17 is a perspective view of the upper portion of the caddy.

With reference to FIGS. 13, 14, and 17, the box-shaped forward portion 490 has a top wall 496, a rear wall 497, sides 498, and a front lip 499, and is defined by an open bottom (see FIG. 17). The forward portion 490 encloses a substantial portion of the latch linkage 460 between the tubular member 245 and the latch 180. On the underside of the box-shaped forward portion 490, the cover plate 470 has a rear engagement portion 500 that is engaged with the rear attachment section 85, and a front engagement portion 505 that is engaged with the front attachment section 90. The engagement portions 500, 505 cooperate with each other to removably attach the cover 55 to the cover linkage 465 so that the cover 55 can be moved between the open position and the closed position via the foot pedal 195.

Figure 15A:
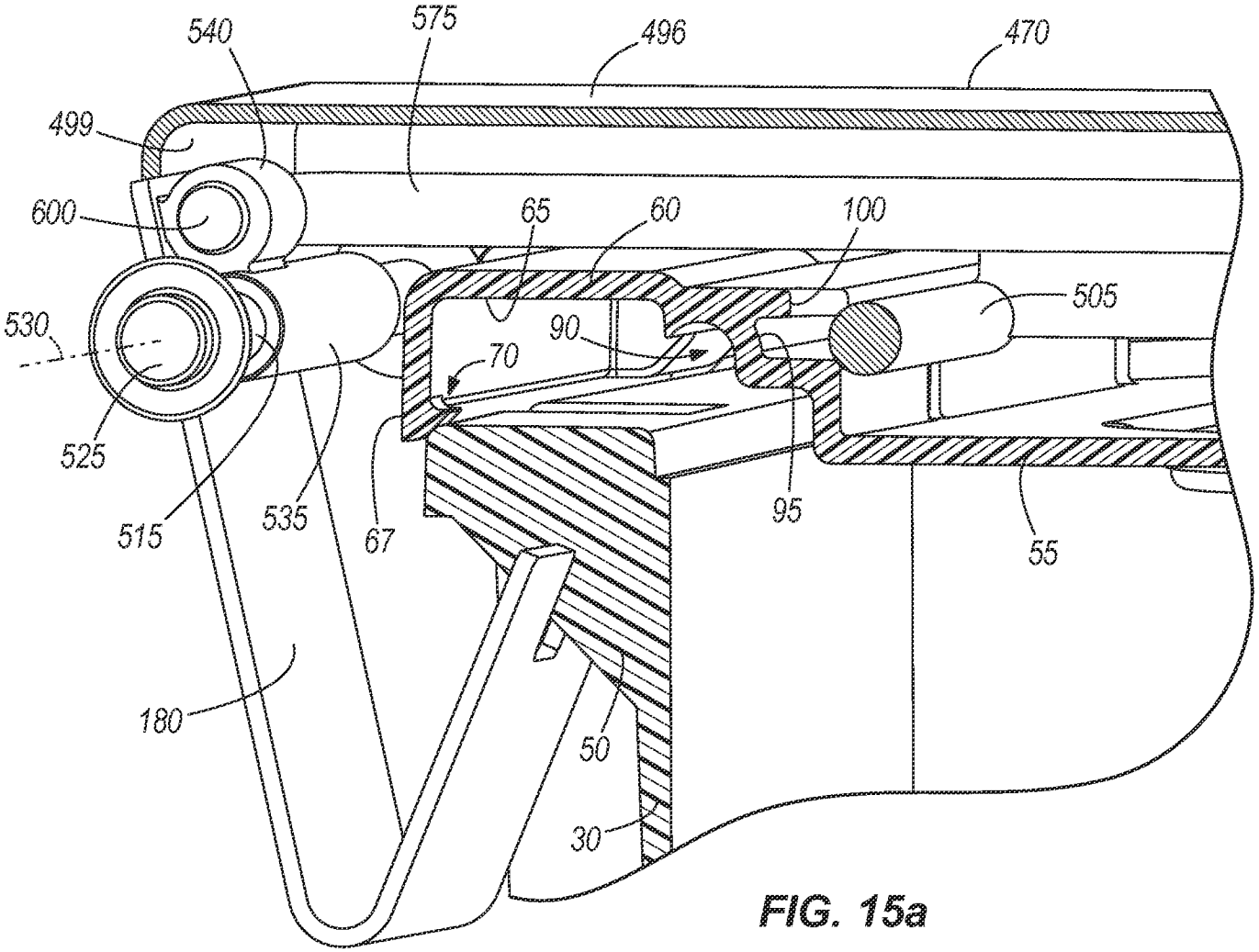
FIG. 15*a* is a section view of a front portion of the cart of FIG. 13 taken along line 15-15 in FIG. 13 and illustrating a portion of the first linkage and the second linkage.
Figure 15B:
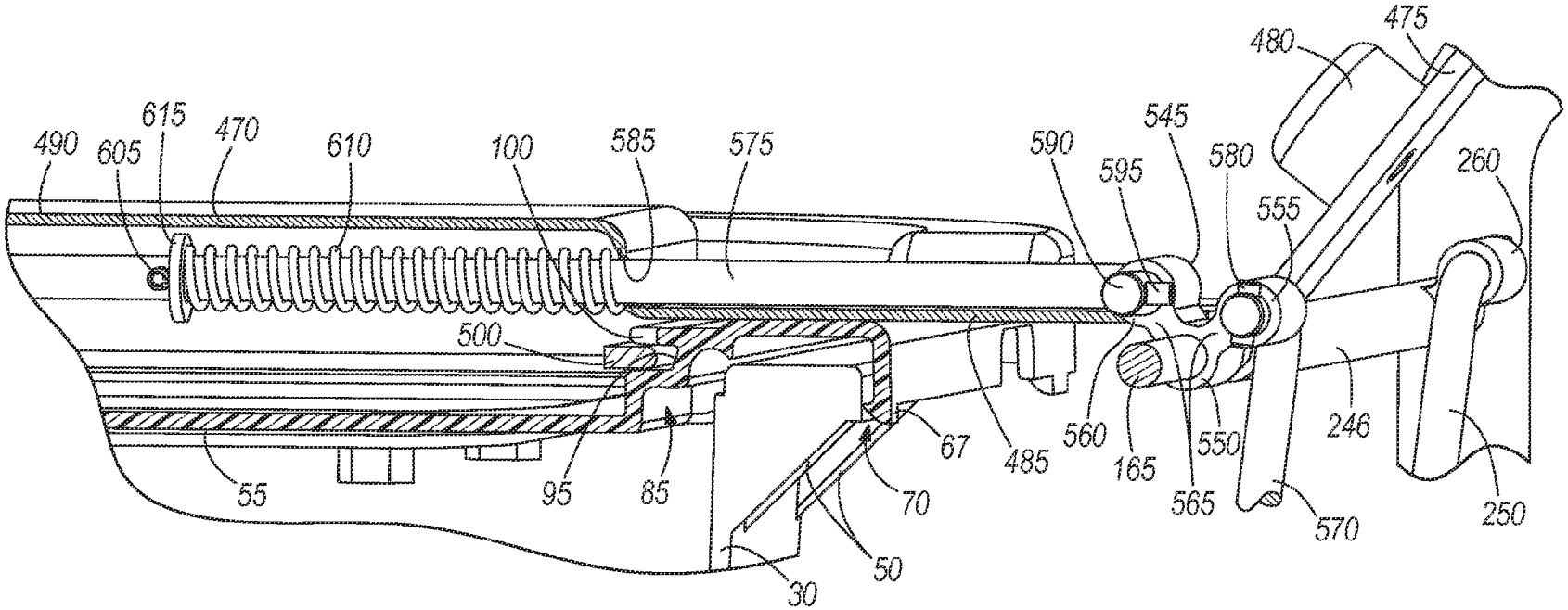
FIG. 15*b* is a section view of a rear portion of the cart of FIG. 13 taken along line 15-15 in FIG. 13 and illustrating a portion of the first linkage and the second linkage.

With reference to FIGS. 15*b* and 17, the rear engagement portion 500 extends laterally across the underside of the plate 470 near the rear wall of the plate 470 and engages the elongated groove 95 of the rear attachment section 85. As shown in FIG. 15*a*, the front engagement portion 505 has a rod-like shape and extends laterally across the underside of the cover plate 470 near the forward end of the cover plate 470. The front engagement portion 505 engages the elongated groove 95 of the front attachment section 90 to hold the plate 470 in engagement with the cover 55 adjacent the forward end of the cover 55. Recesses 510 are located in the sides 498 of the box-shaped forward portion 490 to avoid interference between the cover plate 470 and the front attachment section 90 when the front engagement portion 505 is engaged with the elongated groove 95. The front engagement portion 505 can be snapped downward into this position, as further described below. The cover 55 must be pushed forward relative to the cover plate 470 to insert the rear engagement portion 500 into the groove 95. The plate 470 is attached to the cover 55 such that pivotal movement of the tubular member 245 and the plate 470 in response to downward movement of the rods 250 pivots the cover 55 toward the open position.

FIGS. 15*a* and 17 show that the distal or front end of the cover plate 470 has a support rod 515 that pivotably supports the latch 180 just behind the front lip 499 of the box-shaped forward portion 490. The support rod 515 extends through both sides 498 of the forward portion 490 of the plate 470 and is held in place by cap nuts or locking caps 525, although other attachment mechanisms can be used (e.g., welding, adhesive, etc.). The support rod 515 is spaced a small distance rearward of the front lip 499 to accommodate the latch 180 and so that the latch 180 can pivot between the first position (latched state) and the second position (unlatched state). The latch 180 is pivotable relative to the plate 470 about a horizontal axis 530 defined by the support rod 515, and the front lip 499 can act to limit pivotal movement of the latch 180.

The latch 180 has fixed thereto (e.g., by welding) an elongated sleeve 535 that is disposed on the support rod 515. As illustrated in FIGS. 15*a* and 17, a first latch pivot guide 540 is attached (e.g., welded, integrally formed, etc.) to the sleeve 535 and to the latch 180. Alternatively, either the sleeve 535 or the first latch pivot guide 540 can be secured to the latch 180 (e.g., the sleeve 535 can be welded or adhered or fixed to the latch 180 and the first latch pivot guide 540 can be spaced a small distance from the latch 180) to pivot the sleeve 535 and the latch 180 about the axis 530 when the first latch pivot guide 540 is pushed or pulled, as described in further detail below.

With reference to FIGS. 15*b*, 16, and 17, the latch linkage 460 includes a second latch pivot guide 545 that has a hollow base portion 550 pivotably mounted on the tubular member 245 between the segments 246. First and second guide sleeves 555, 560 extend outward from the base portion 550 and are connected to the base portion 550 and to each other by a bridge 565 such that the second guide sleeve 560 moves or pivots with the first guide sleeve 555 in response to movement of the first guide sleeve 555. The first guide sleeve 555 extends generally upward and rearward from the base portion 550 (toward the handle 450), and the second guide sleeve 560 extends generally upward and forward from the base portion 550 (toward the front of the cart 410) such that lines drawn between the center points of the base portion 550 and the first and second guide sleeves 555, 560 forms a triangle (e.g., an equilateral triangle). As illustrated in FIGS. 15*b*, 16, and 17, the second latch pivot guide 545 is located on the tubular member 245 within one of the recessed areas 495 of the cover plate 470 so that the second latch pivot guide 545 can pivot relative to the tubular member 245 and the cover plate 470.

Referring to FIGS. 14-18, the latch linkage 460 also includes a first latch connector rod 570 and a second latch connector rod 575. As shown in FIG. 14, the first latch connector rod 570 extends between the actuating rod 210 and the second latch pivot guide 545, and is operatively coupled to the foot pedal 195 by any suitable means (e.g., welding, a fastener such as a washer and pin combination, cap nut, etc.). The attachment is such that downward movement of the connector 210 when the foot pedal 195 is in the normal position and the cover 55 is in the closed position immediately causes downward movement of the first latch connector rod 570. The first latch connector rod 570 is routed upward from the actuating rod 210 through the guide plate 235 to the second latch pivot guide 545. The upper end of the first latch connector rod 570 is bent at a ninety-degree angle and extends into the first guide sleeve 555 such that the end of the rod 570 is pivotable relative to the first guide sleeve 555. As illustrated in FIG. 16, a pin 580 extends through the first latch connector rod 570 to prevent the rod 570 from slipping out of the first guide sleeve 555.

As shown in FIGS. 15*a*-17, the second latch connector rod 575 extends between the first latch pivot guide 540 and the second latch pivot guide 545, and the rod 575 passes through a hole 585 in the rear wall 497 of the box-shaped forward portion 490 of the cover plate 470 and underneath the top wall 496. The ends of the second latch connector rod 575 are bent at a ninety-degree angle relative to the elongated portion of the rod 575. With reference to FIGS. 15*b* and 16, the rearward bent end 590 of the second latch connector rod 575 extends into the second guide sleeve 560 such that the end 590 is pivotable relative to the second guide sleeve 560. As illustrated, a pin 595 extends through the rearward bent end 590 to prevent the rod 575 from slipping out of the second guide sleeve 560. The forward bent end 600 of the second latch connector rod 575 (see FIG. 15*a*) extends into the first latch pivot guide 540 such that the end 600 is pivotable relative to the first latch pivot guide 540. Although not shown, a pin similar to the pin 595 can be used to prevent the rod 575 from slipping out of the first latch pivot guide 540.

With reference to FIGS. 15*b* and 17, a stop element 605 (e.g., a pin) passes through the second latch connector rod 575 at a location that is forward of the rear wall 497. A compression spring 610 and a washer 615 are disposed about the second latch connector rod 575 between the rear wall 497 and the stop element 605 to bias the latch 180 to the first position (latched state). As described in detail below, the spring 610 acts on the rear wall 497 and the stop element 605 to hold the latch 180 in the first position absent a force on the foot pedal 195, and returns the latch 180 to the first position after a force on the foot pedal 195 is released.

The latch 180 is movable between the first position (see FIG. 15*a*) corresponding to the latched state and the second position (see FIG. 20*a*) corresponding to the unlatched state. The foot pedal 195 is movable downward a first distance D1 (FIG. 20*b*) from the normal position to a middle or intermediate position (FIGS. 12*b* and 20*b*) to pull on the first and second latch connector rods 570, 575 and to move the latch 180 from the first position to the second position. When the foot pedal 195 reaches the intermediate position, the actuating rod 210 engages the nuts 457 so that further downward movement of the foot pedal 195 will pull down on the rods 250. The foot pedal 195 is movable downward an additional or second distance D2 (FIG. 21*b*) beyond the first distance D1 and beyond the intermediate position to a lowermost or down or open position. During movement from the intermediate position to the lowermost position, the foot pedal 195 engages the latch linkage 460 and the cover linkage 465 (i.e., pulls down on the rods 250) to hold the latch 180 in the unlatched state and to move the cover 55 toward the open position. The cover 55 is in the open or up position when the foot pedal 195 is moved from the normal position to the lowermost position. The second distance D2 is in the same direction as the first distance D1. While in the illustrated construction the second distance D2 is greater than the first distance D1, this need not be the case.

The cover 55 is attached to the plate 470 by inserting the rear engagement portion 500 into the rear attachment section 85 (i.e., by inserting the lip of the rear engagement portion 500 into the groove 95). The rod-like shaped front engagement portion 505 is then snapped or pushed into engagement with the front attachment section 90 (i.e., with the rod-like shaped member engaging the groove 95). The cover 55 is thus releasably held in engagement with the cover linkage 465 via the plate 470 so that the cover 55 can be opened and closed in response to movement of the cover linkage 465.

Except as described below, operation of the cart 410 described with regard to FIGS. 13-21*b* is similar to operation of the cart 10 described with regard to FIGS. 1-12*b*. Generally, the latch 180 holds the cover 55 in the closed position when the foot pedal 195 is in the normal position. The latch 180 cooperates with the plate 470 to hold the cover 55 in the closed position, but after the latch 180 is released (i.e., in the unlatched state), a person can lift the front end of the cover 55 to open the cover 55. FIGS. 20*a* and 20*b* show the foot pedal 195 moved or depressed the first distance D1 to the middle or intermediate position to vary the latch 180 from the latched state to the unlatched state. When the foot pedal 195 is moved the first distance D1, the following happen: (1) the actuating rod 210 moves relative to the connector rods 250 such that the actuating rod 210 just engages the nuts 457 attached to the connector rods 250; (2) the actuating rod 210 pulls on the first latch connector rod 570, which pivots the second latch pivot guide 545 about the tubular member 245 and in turn pulls on the second latch connector rod 575 so that the latch 180 pivots about the support rod 515 to disengage the latch 180 from the container 15; (3) the spring 610 is compressed a small amount against its bias by the washer 615 in response to movement of the stop element 605 with the second latch connector rod 575; (4) the springs 200 are pulled or extended a relatively small amount against their bias; and (5) the cover 55 remains in the closed position due to the lost motion between the bottom of the actuating rod 210 and the connector rods 250.

Figure 21A:
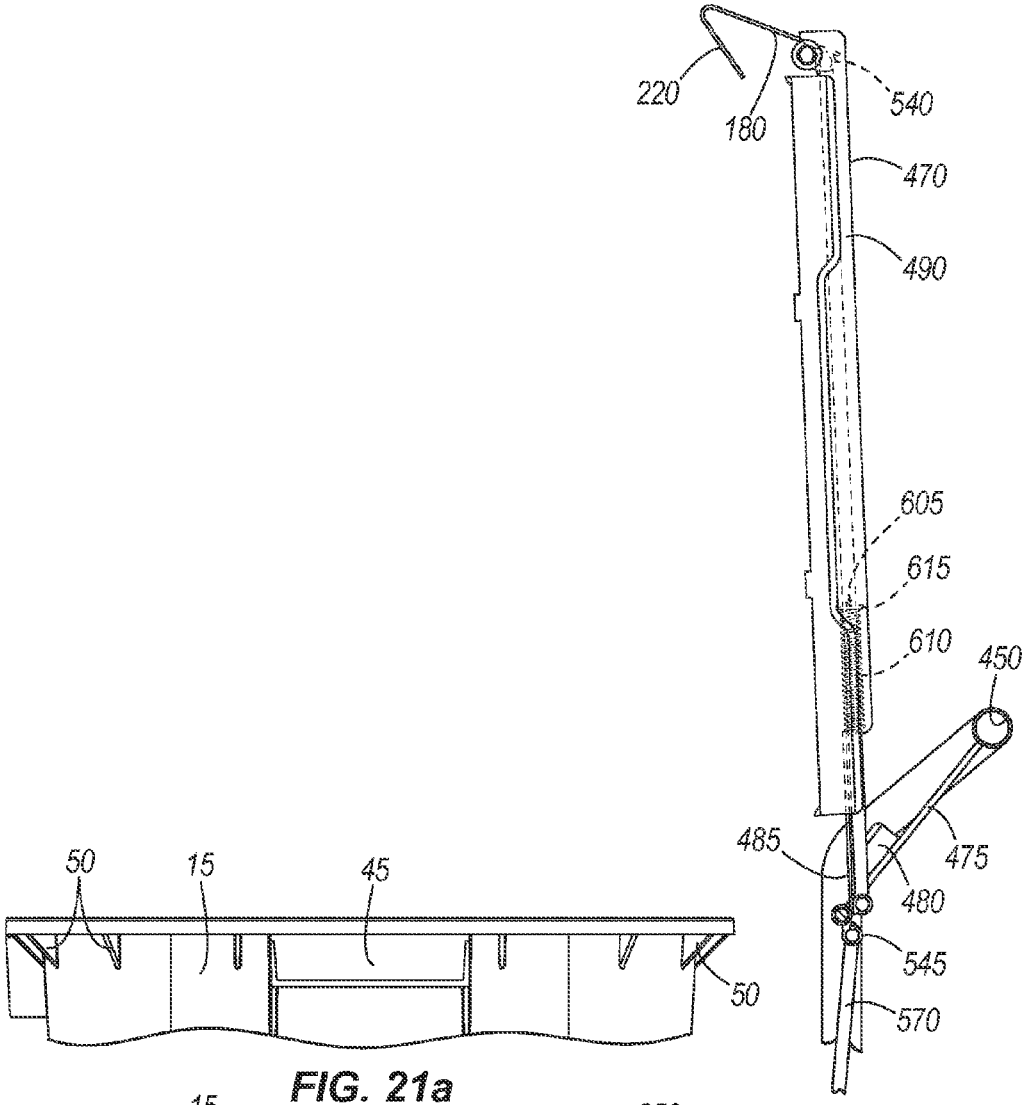
FIG. 21*a* is a view similar to FIG. 19*a* showing the latch in the unlatched state and the cover in an open position.
Figure 21B:
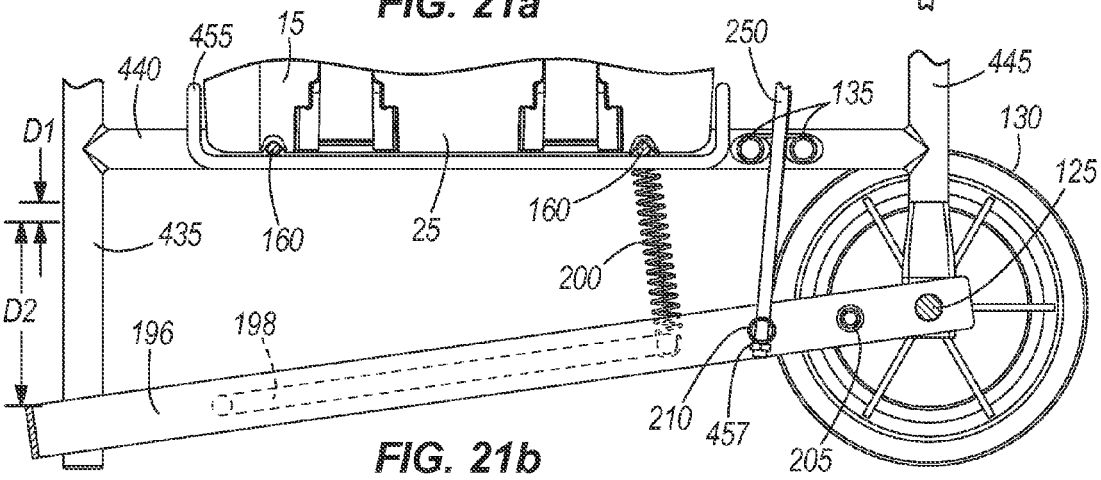
FIG. 21*b* is a view similar to FIG. 19*b* with the foot pedal pushed down to a lowermost position.

FIGS. 21*a* and 21*b* show the foot pedal 195 moved or depressed the second distance D2 to the down position. When the foot pedal 195 is moved the second distance D2, beyond the first distance D1, the following happen: (1) downward movement of the actuating rod 210 holds the first and second latch connector rods 570, 575 so that the latch 180 is held or remains in the unlatched state; (2) the actuating rod 210 pulls the connector rods 250 downward due to engagement of the actuating rod 210 with the nuts 457, and downward movement of the connector rods 250 pulls on the pivot guides 260, which pivots the tubular member 245 and the plate 470 about the axis 270, thereby moving the cover 55 to the open position; and (3) the springs 200 are pulled or extended a relatively large amount against their bias.

With reference to FIG. 21*a*, the plate 470 hits the stop 480 when the cover 55 is in the open position. As illustrated, the cover 55 defines an angle of less than ninety degrees relative to the horizontal plane defined by the flange 40. As such, when the cover 55 is in the open position, gravity biases the cover toward the closed position, but the cover will remain up as long as the foot pedal 195 is depressed. Also, the latch 180 remains in the unlatched state as long as the foot pedal 195 is depressed.

Upon release of the foot pedal 195, the springs 200 pull the foot pedal 195 upward to the normal position. Movement of the foot pedal 195 and the actuating rod 210 back to the normal position removes the downward force on the nuts 457 so that the connector rods 250 are free to move upward. Once the connector rods 250 are no longer holding the cover 55 up, gravity causes the cover 55 to drop to the closed position. Normally, an operator will lift his or her foot slowly so that the foot pedal 195 moves up slowly and the cover 55 closes slowly. The latch 180 remains in the unlatched state until the cover 55 reaches the closed position. At that point, the tension on the second latch pivot guide 545 is removed and the bias of the spring 610 pushes forward on the washer 615 and the stop element 605, and thus the second latch connector rod 575. Forward movement of the connector rod 575 pivots the latch 180 to the latched state due to the bias provided by the spring 610.

The hands-free mechanism 175 disengages the latch 180 from the container 15 to permit movement of the cover 55 to the open position. The hands-free mechanism 175, the latch linkage 460, and the cover linkage 465 cooperate with each other to sequentially vary the latch 180 to the unlatched state and open the cover 55. The sequential operation of the latch linkage 460 and the cover linkage 465 minimizes the steps needed to move the cover 55 from the closed position to the open position. Stated another way, the hands-free mechanism 175, the latch linkage 460, and the cover linkage 465 disengage the latch 180 from the cover 55 via operation of the same foot pedal 195 that opens the cover 55.

Movement of the foot pedal 195 the first distance D1 from the normal position engages the latch linkage 460 without engaging the cover linkage 465 to vary the latch 180 to the unlatched state. The latch 180 is temporarily moved against the bias of the spring 610 by the foot pedal 195 to permit movement of the cover 55 to the open position when the foot pedal 195 is moved the additional second distance D2. The latch 180 is held against the bias by the hands-free mechanism 175 and the latch linkage 460 when the hands-free mechanism 175 and the cover linkage 465 are manipulated to move the cover 55 between the closed position and the open position. That is, the latch 180 is held in the unlatched state whenever the foot pedal 195 is not in the normal position.

FIGS. 22-28*b* show another cart 710 including the container 15 and a caddy 720 for supporting the container 15. Except as described below, the cart 710 and the caddy 720 are the same as the cart 410 and the caddy 420, respectively, and common elements are given the same reference numerals. In particular, the caddy 720 includes the frame 425 with the primary upright frame member 430, the secondary upright frame members 435, the base frame members 440, the side portions 445, the handle 450, and the U-shaped cradle 455 for holding the container 15 in place on the caddy 720. The caddy 720 also includes the lost-motion connection between the actuating rod 210 and the connector rods 250.

Figure 22:
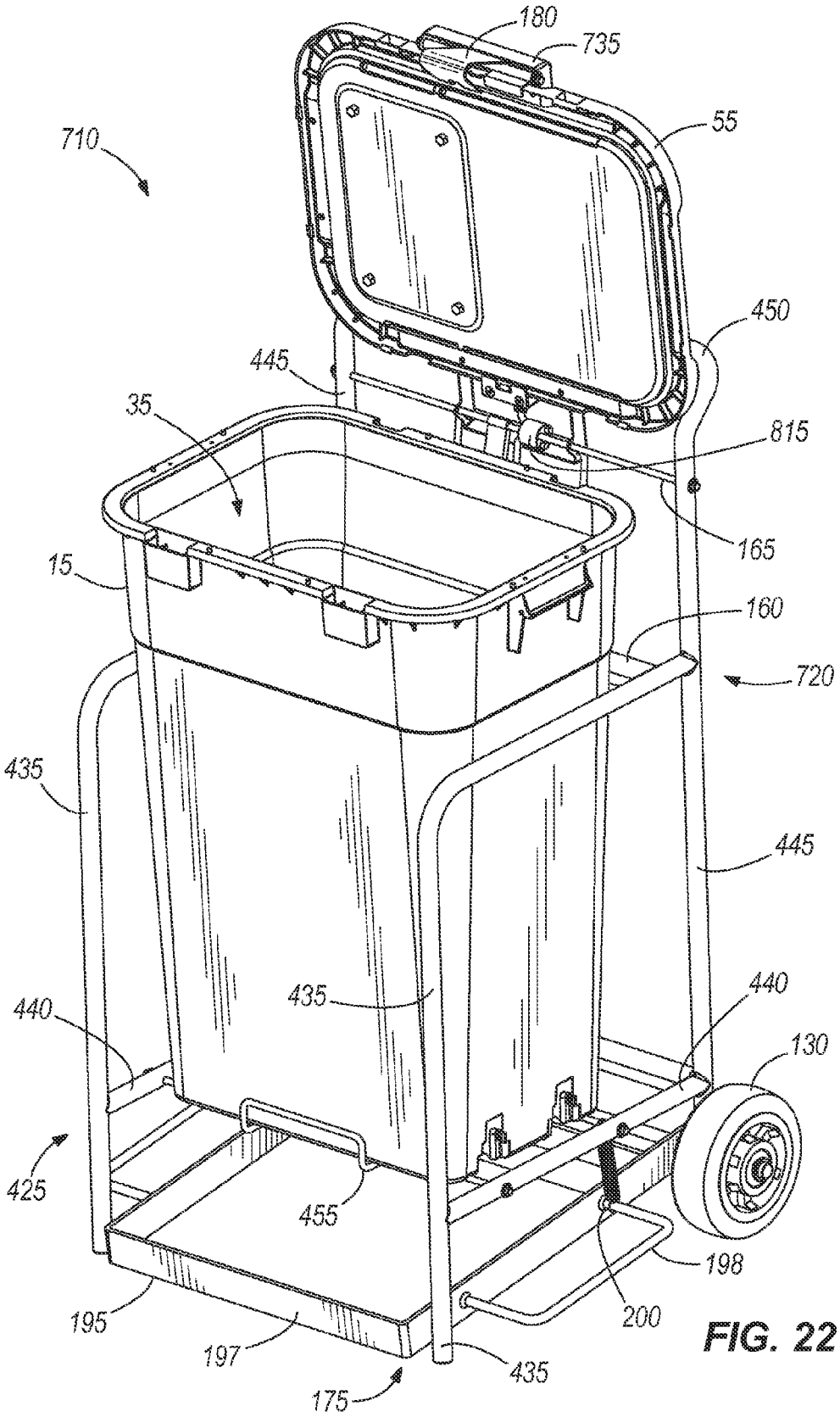
FIG. 22 is a perspective view of another cart including the container, the latch, and a caddy supporting the container of FIG. 1.
Figure 23:
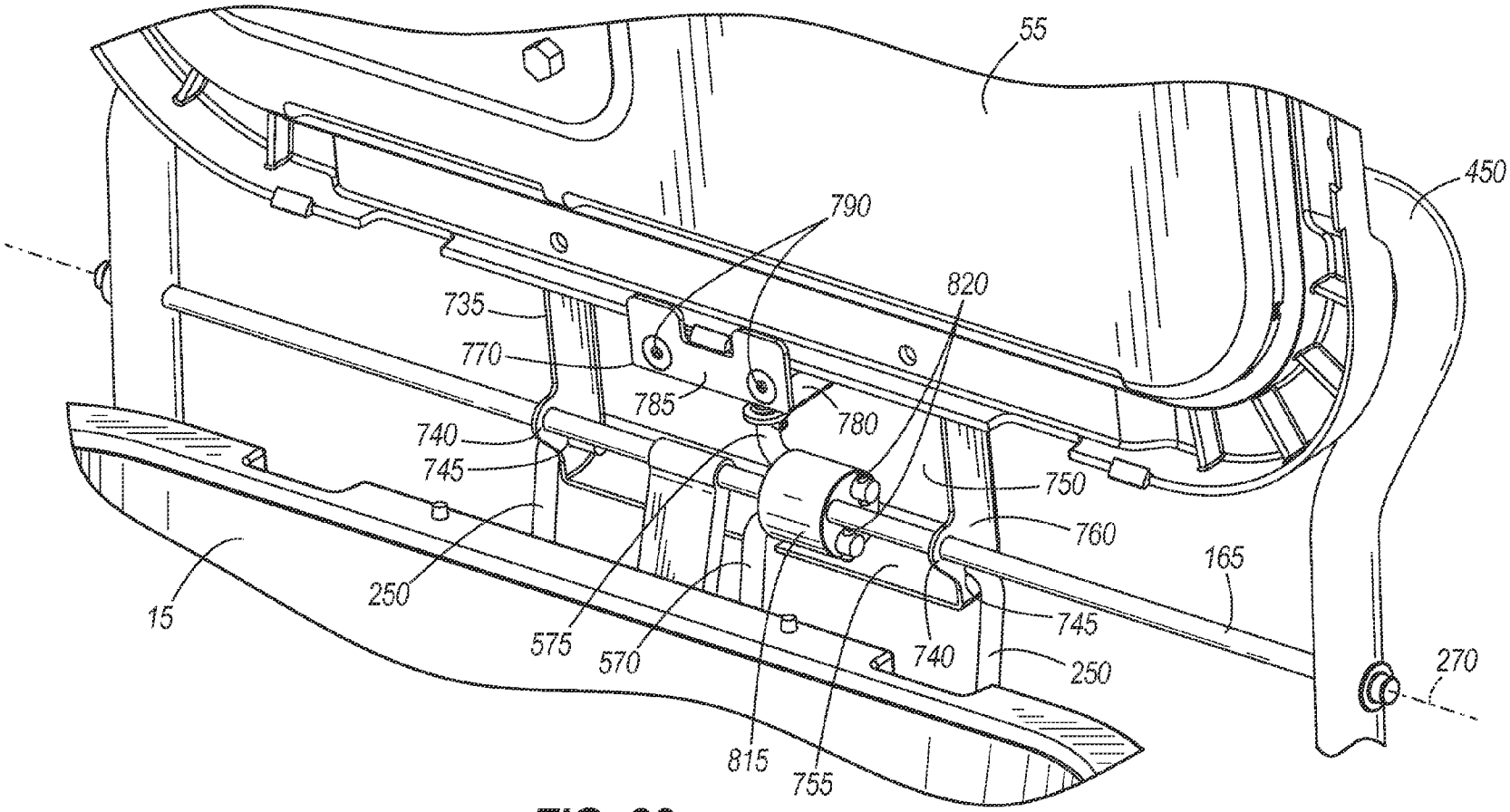
FIG. 23 is a perspective view of an upper rear portion of the cart of FIG. 22 including a caddy and a container with a cover.
Figure 24:
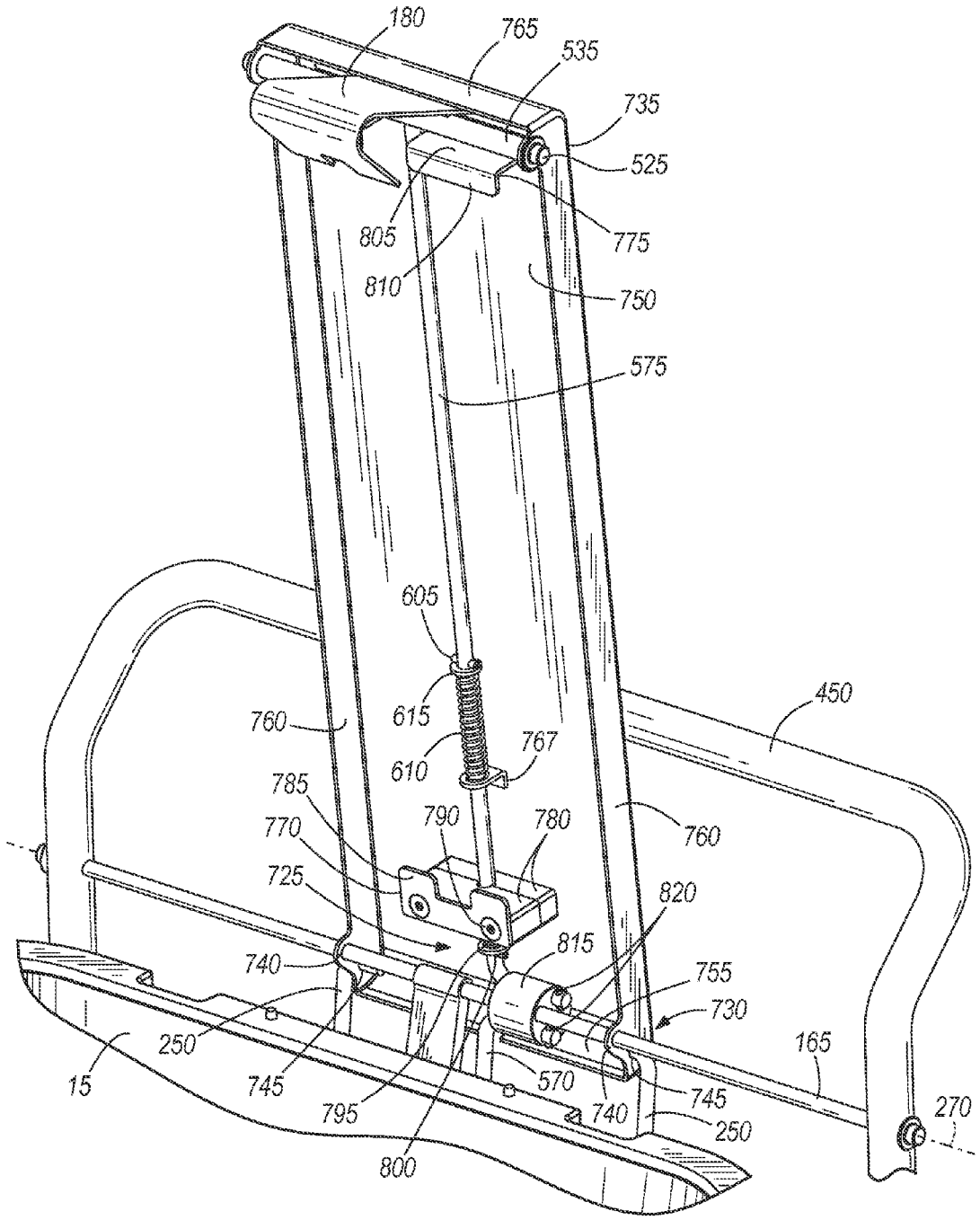
FIG. 24 is another perspective view of the upper portion of the cart of FIG. 22 without the cover.

With reference to FIGS. 22-24, the cart 710 also includes the hands-free mechanism 175, the latch 180, a first or latch linkage 725 coupled between the hands-free mechanism 175 and the latch 180 and including the first latch connector rod 570 and the second latch connector rod 575, and a second or cover linkage 730 coupled between the cover 55 and the hands-free mechanism 175 and including the connector rods 250. The foot pedal 195 is coupled to the latch linkage 725 and to the cover linkage 730 as described with regard to FIGS. 13-21*b*.

The hands-free mechanism 175 is coupled to the container 15 and is engaged with the cover 55 via the cover linkage 730 to move the cover 55 between the open position and the closed position. As illustrated in FIGS. 22-24, the cover linkage 730 includes the connector rods 250 that extend upward from the actuating rod 210 to a cover plate 735 that is directly pivotably attached to the rod 165 through ear projections 740 on opposite sides of the cover plate 735. The cover plate 735 can pivot relative to the rod 165 about the pivot axis 270, or the cover plate 735 can pivot with the rod 165 about the axis 270. The upper ends of the connector rods 250 are bent at a ninety-degree angle and extend into respective pivot guides 745 defined in the rearward end of the cover plate 735 such that the ends of the rods 250 are pivotable relative to the cover plate 735.

Figure 25:
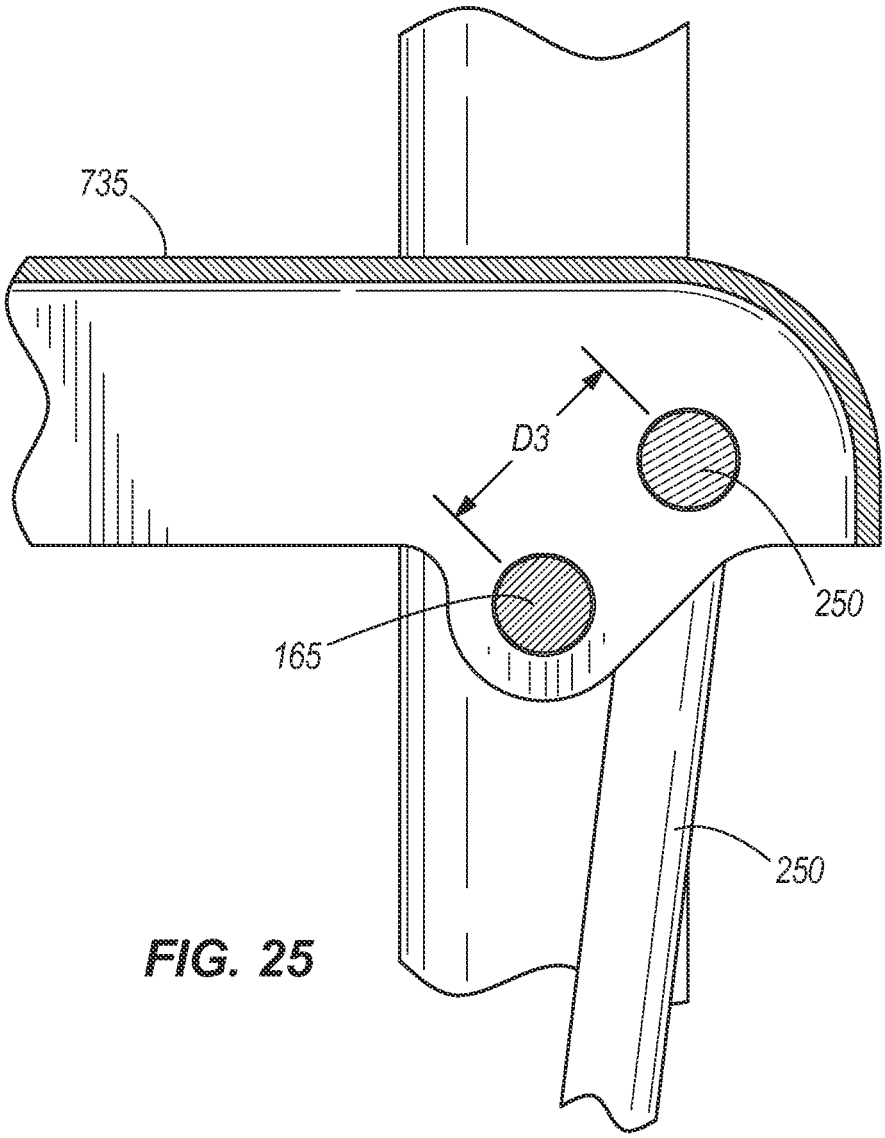
FIG. 25 is a section view of a portion of the cart taken along line 25-25 in FIG. 24.
Figure 26A:
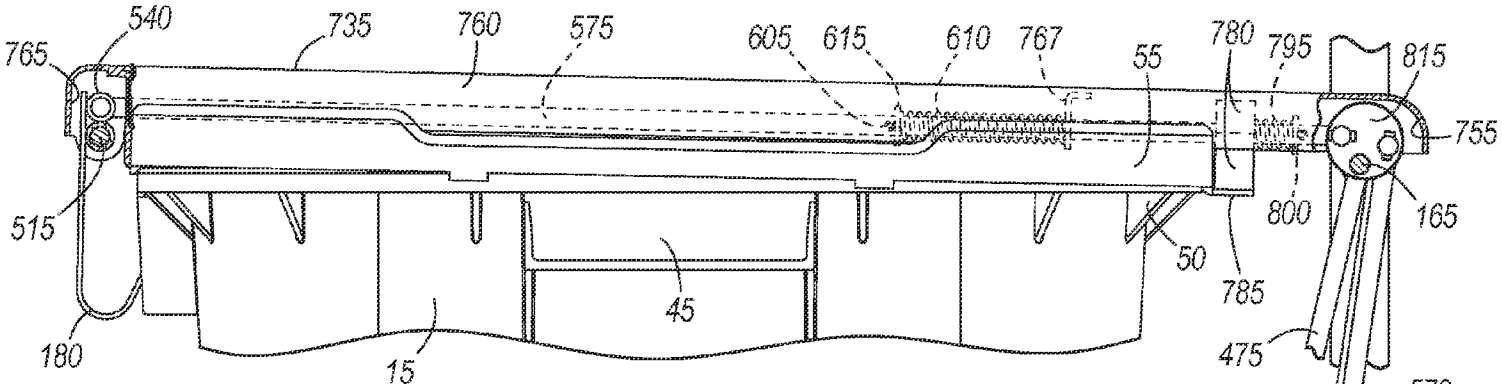
FIG. 26*a* is a side view of the upper portion of the cart showing the latch in the latched state and the cover in a closed position.
Figure 26B:
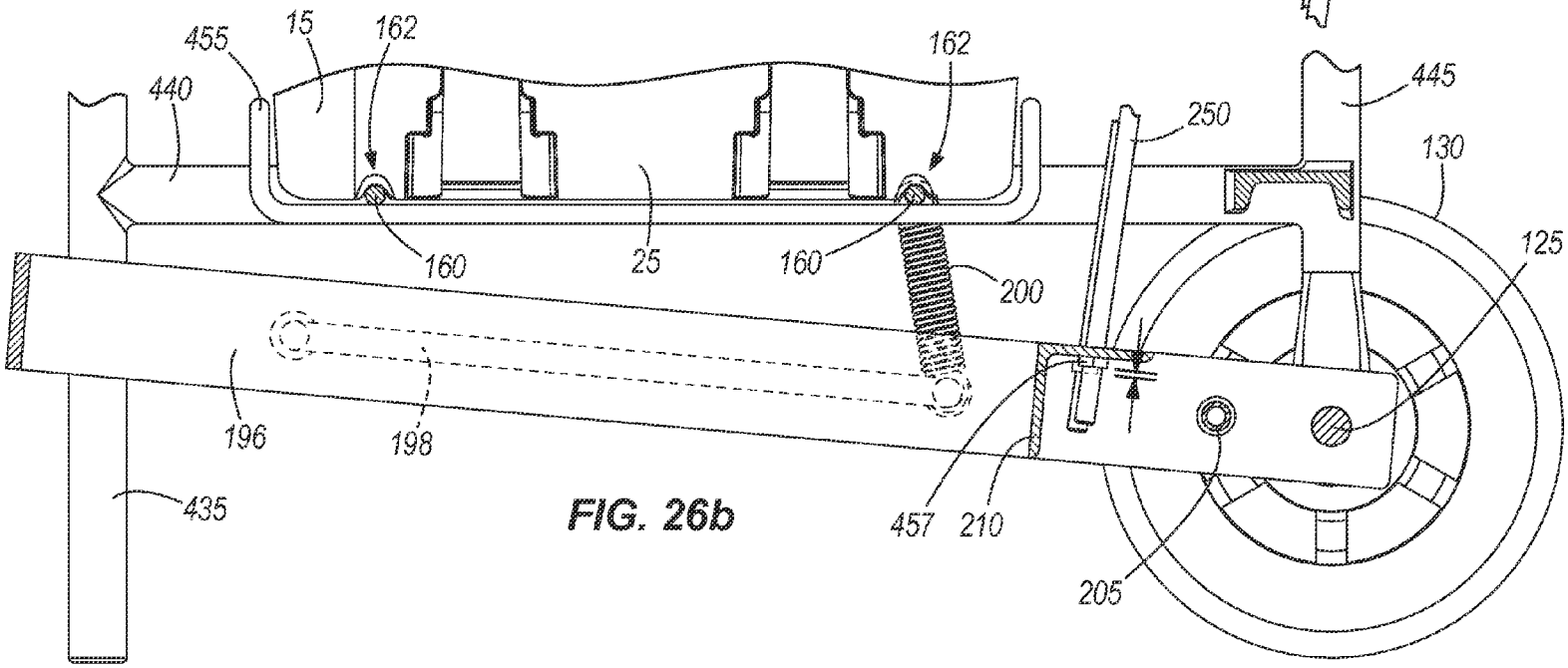
FIG. 26*b* is a section view of the cart showing the lower portion of the cart with the foot pedal in the normal position.
Figure 27A:
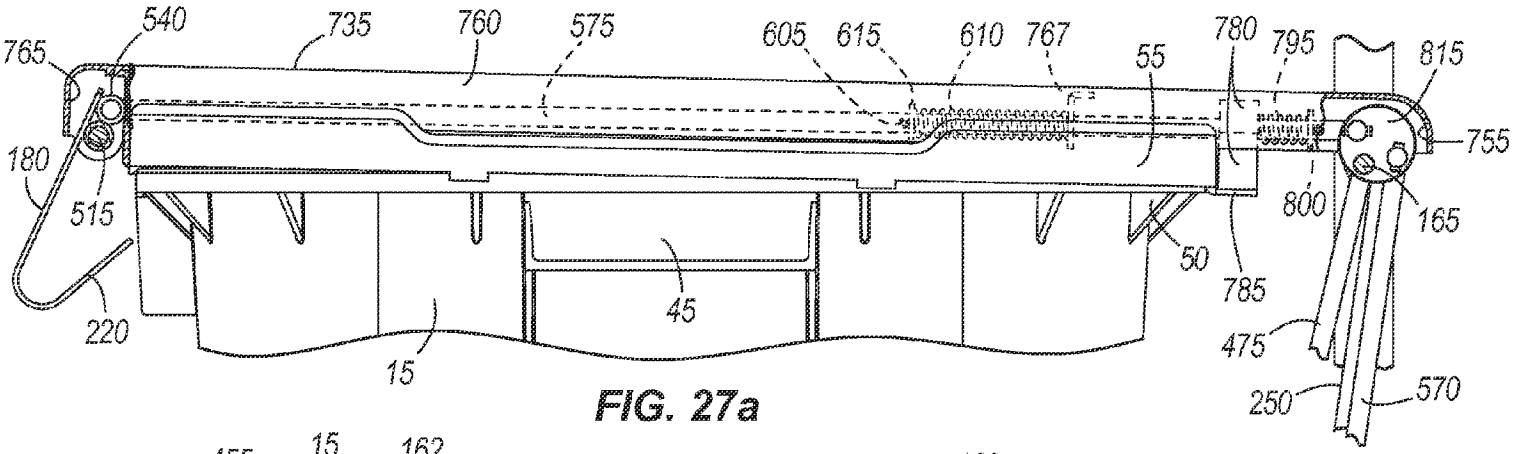
FIG. 27*a* is a view similar to FIG. 26*a* showing the latch in the unlatched state and the cover in the closed position.
Figure 27B:
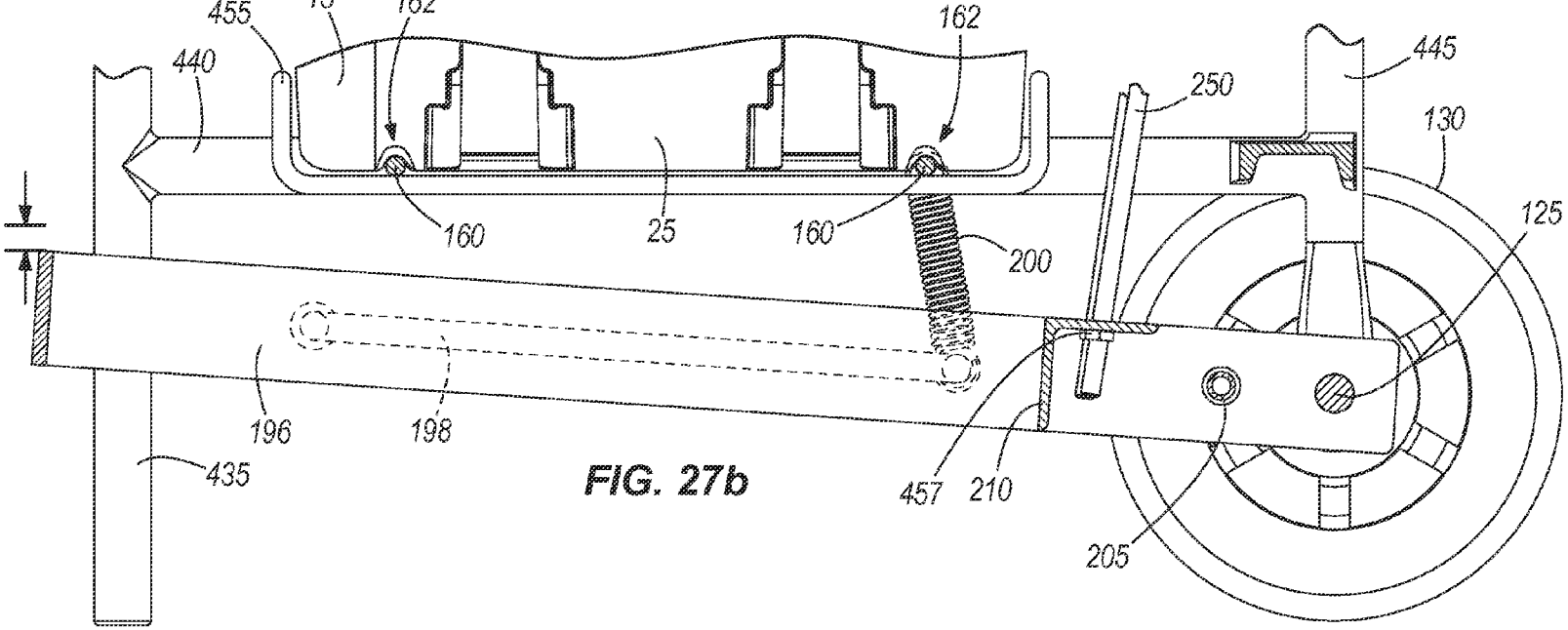
FIG. 27*b* is a view similar to FIG. 26*b* with the foot pedal pushed down to the intermediate position.
Figure 28A:
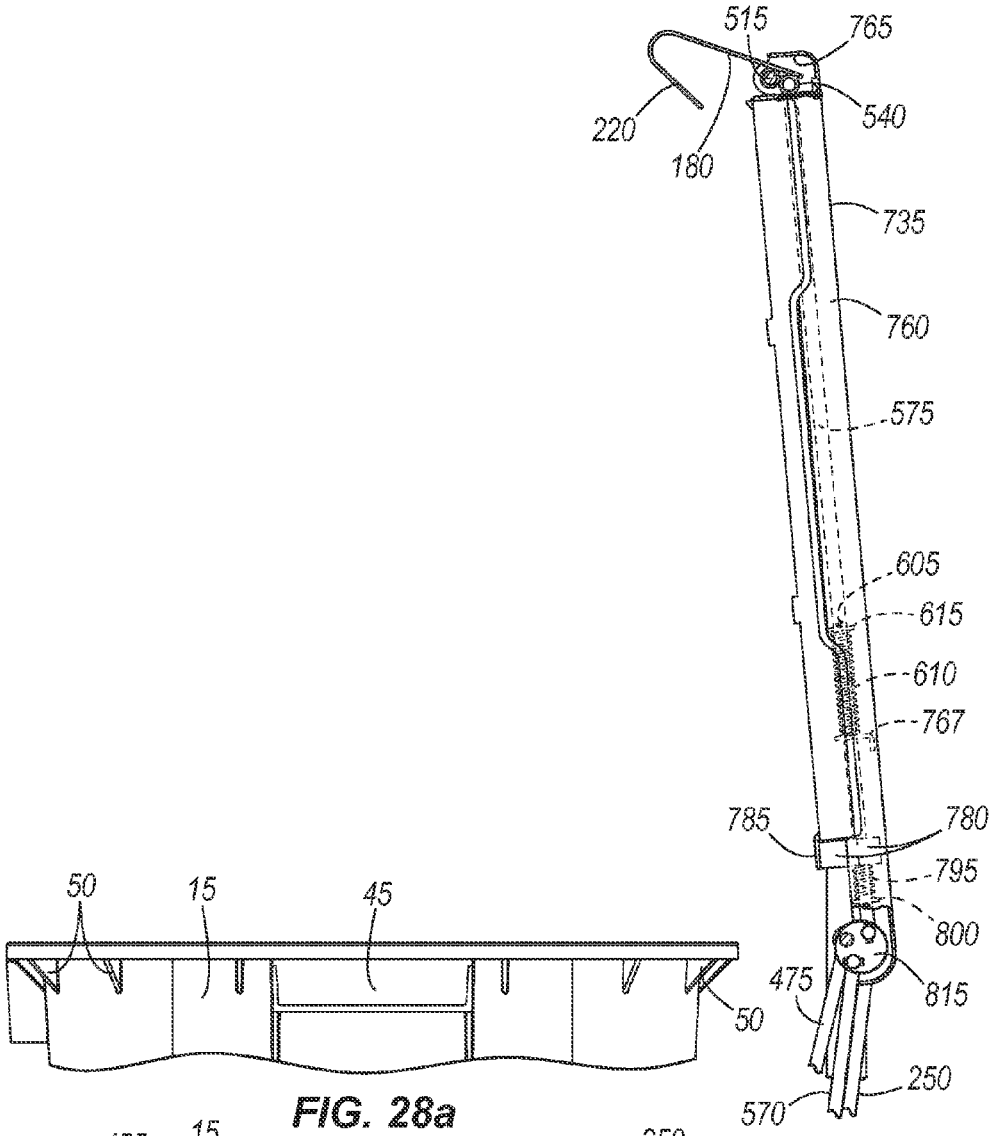
FIG. 28*a* is a view similar to FIG. 26*a* showing the latch in the unlatched state and the cover in an open position.
Figure 28B:
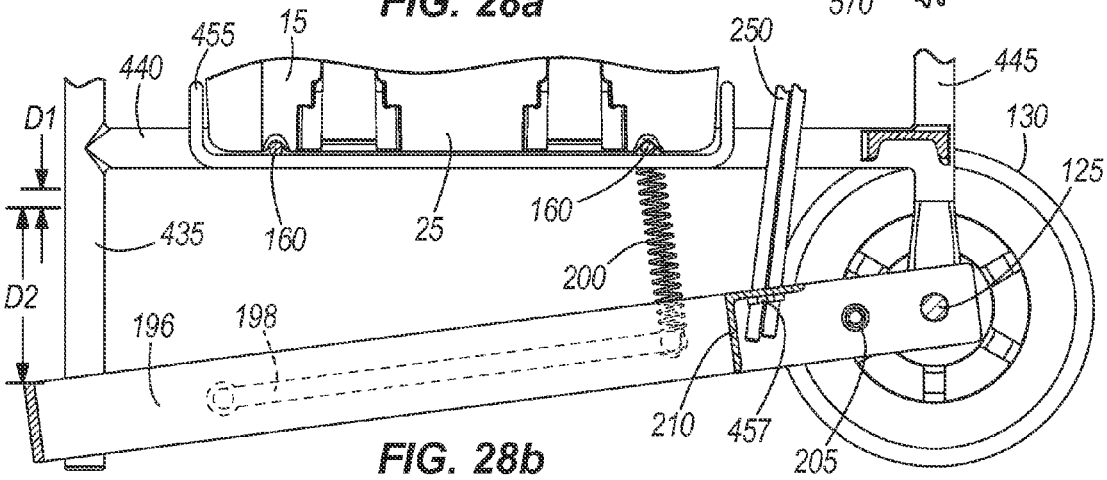
FIG. 28*b* is a view similar to FIG. 26*b* with the foot pedal pushed down to the lowermost position.

With reference to FIG. 25, the cover plate 735 straddles the rod 165 (i.e., the cover plate 735 has a portion forward and rearward of the rod 165). The upper ends of the connector rods 250 are coupled to the rearward end of the cover plate 735 at a point behind or rearward of the rod 165 so that the cover plate 735 is pivotable about the horizontal axis 270. As illustrated, the upper ends of the connector rods 250 are spaced from the rod 165 by a center-to-center distance D3 (e.g., 0.5 inches). The distance D3 is larger than the center-to-center distance between the rod 165 and the pivot guides 260 described with regard to FIGS. 1-21*b* to provide more leverage for pivoting the cover plate 735 relative to the embodiments of FIGS. 1-21*b*.

The illustrated cover plate 735 is box-shaped and extends over the cover 55 adjacent the recessed sections 80 such that the cover plate 735 is partially recessed relative to the cover 55. With reference to FIGS. 23 and 24, the cover plate 735 has a top wall 750, a rear wall 755, sides 760, and a front lip 765, and is defined by an open bottom. The cover plate 735 encloses a substantial portion of the latch linkage 725 between the rod 165 and the latch 180, and has a stop plate 767 that supports the spring 610. The stop plate 767 is the functional equivalent of the rear wall 497 for the latch linkage 460 described in view of FIGS. 13-21*b*. On its underside, the cover plate 735 has a rear engagement portion or mechanism 770 that is supported by the latch linkage 725, and a front engagement portion or mechanism 775 that is coupled (e.g., welded) to the top wall 750. The engagement mechanisms 770, 775 cooperate with each other to removably attach the cover 55 to the cover linkage 730 so that the cover 55 can be moved between the open position and the closed position via the foot pedal 195.

With reference to FIGS. 23 and 24, the rear engagement mechanism 770 has a back plate 780 slidably coupled to second connector rod 575, and a foot plate 785 that is attached to the back plate 780. The back plate 780 and the foot plate 785 cooperatively support the rear end of the cover 55 (FIG. 23). The illustrated back plate 780 is formed from two pieces 780*a*, 780*b* that encapsulate or sandwich a portion of the second connector rod 575 so that the back plate 780 can be attached after the latch linkage is assembled. Also, the foot plate 785 is secured to the back plate 780 using fasteners 790. The fasteners 790 pass through one back plate piece 780*a* and into the other back plate piece 780*b* to hold the back plate 780 in place on the connector rod 575. As illustrated, the rear engagement mechanism 770 also has a spring 795 that is supported by a stop 800 (e.g., a washer and pin combination) on the second connector rod 575 to bias the back plate 780 toward the latch 180 (i.e., toward the front of the cart 710) to permit attachment of the cover 55 to the cover plate 735 as described in detail below.

As shown in FIGS. 22 and 24, the front engagement mechanism 775 includes support brackets 805 (one shown) on opposite sides of the second connector rod 575 that are coupled to the top wall 750 (e.g., welded) and that have with flanges 810. When the cart 710 is assembled, the front of the cover 55 is coupled to the brackets 805 and is held in engagement with the cover plate 735 by the flanges 810.

The latch 180 is pivotably supported on the cover plate 735 just behind the front lip 765 by the support rod 515. The latch 180 is pivotable relative to the cover plate 735 about the horizontal axis 530, and the front lip 765 can act to limit pivotal movement of the latch 180. The first latch pivot guide 540 is attached to the sleeve 535 and to the latch 180. A second latch pivot guide 815 is pivotably mounted on the rod 165 and interconnects the first latch connector rod 570 and the second latch connector rod 575. As illustrated, the second latch pivot guide 815 is cylindrical, although other shapes are possible and considered herein. The pivot guide 815 is coupled to the rod 165 toward the outer periphery of the pivot guide 815, and the first and second latch connector rods 570, 575 are pivotably supported in the pivot guide 815 near or along the diameter of the pivot guide 815. The upper ends of the first and second latch connector rods 570, 575 are bent at a ninety-degree angle and extend into the pivot guide 815 such that the end of the rod 570 is pivotable relative to the pivot guide 815. As illustrated in FIG. 23, pins 820 extend through each of the first latch connector rod 570 and the second latch connector rod 575 to prevent the rods 570, 575 from slipping out of the pivot guide 815.

The first and second latch connector rods 570, 575 and spaced apart from each other and from the rod 165 so that movement of the first connector rod 570 pivots the pivot guide 815 about the horizontal axis 270, which in turn moves the second connector rod 575. Stated another way, the pivot guide 815 supports the rod 165 and the first and second latch connector rods 570, 575 in spaced relation so that pivotal movement of the pivot guide 815 caused by movement of the first connector latch rod 570 transfers that movement to the second latch connector rod 570.

With reference to FIGS. 23 and 24, the cover 55 is attached to the cover plate 735 by positioning the rear end of the cover 55 into the rear engagement portion 770 so that the cover 55 is engaged with the back plate 780. The foot plate 785 holds the rear end of the cover 55 in engagement with the cover plate 735. In this position, the cover 55 is angled slightly relative to the cover plate 735 (i.e., the front end of the cover 55 is spaced from the front end of the cover plate 735). The cover 55 is then pushed against the bias of the spring 795 so that the front end of the cover 55 clears the front engagement portion 775. The front end of the cover 55 is then pivoted within the rear engagement portion 770 so that the cover 55 is aligned with the front engagement portion 775. At this point, rearward (or downward) pressure on the cover 55 is released so that the spring 790 can bias the back plate 780 and the cover 55 forward so that the cover 55 is engaged with the brackets 805 of the front engagement portion 775. The flanges 810 hold the front end of the cover 55 in engagement with the cover plate 735. The cover 55 is thus releasably held in engagement with the cover linkage 730 via the plate 735 so that the cover 55 can be opened and closed in response to movement of the cover linkage 730.

With reference to FIGS. 26*a*-28*b*, the latch 180 is movable between the first position (FIG. 26*a*) corresponding to the latched state and the second position (FIG. 27*a*) corresponding to the unlatched state via the latch linkage 725 in the same manner as described with regard to FIGS. 13-21*b*. As will be appreciated from the foregoing description and the drawings, operation of the cart 710 including the caddy 720 described with regard to FIGS. 22-28*b* also is the same as operation of the cart 410 including the caddy 420 described with regard to FIGS. 13-21*b*.

Various features and advantages of the invention are set forth in the following claims.

The invention claimed is:

1. A cart comprising:

a container defining an interior space;

a cover movable between an open position providing access to the interior space and a closed position inhibiting access to the interior space;

a latch located between the container and the cover to releasably hold the cover in the closed position;

a caddy including a hands-free mechanism coupled to the latch and operable to disengage the latch from one of the container or the cover to permit movement of the cover to the open position; and a lost-motion connection between the hands-free mechanism and the cover such that the latch is disengageable without simultaneous movement of the cover toward the open position.

2. The cart of claim 1, wherein the latch is coupled to the cover and biased into engagement with the container, and wherein the hands-free mechanism is configured to disengage the latch from the container prior to moving the cover from the closed position to the open position.

3. The cart of claim 1, further comprising a plate engaged with the cover and pivotable in response to operation of the hands-free mechanism to pivot the cover to the open position.

4. The cart of claim 3, wherein the latch is pivotably coupled to an end of the plate.

5. The cart of claim 1, the caddy supports the container.

6. The cart of claim 1, wherein the latch is biased to hold the cover in the closed position, and wherein the latch is configured to be temporarily moved against the bias to permit movement of the cover to the open position.

7. The cart of claim 6, wherein the latch is held against the bias by the hands-free mechanism when the cover moves between the open position and the closed position.

8. The cart of claim 1, further comprising a first linkage coupled between the hands-free mechanism and the latch, and a second linkage coupled between the hands-free mechanism and the cover.

9. The cart of claim 8, wherein the hands-free mechanism includes a foot pedal coupled to the first linkage and the second linkage, and wherein the foot pedal engages the first linkage to disengage the latch and engages the second linkage to move the cover to the open position.

10. A cart comprising:

a container defining an interior space;

a cover movable between an open position providing access to the interior space and a closed position inhibiting access to the interior space;

a latch coupled to the cover and movable with the cover to the open position, the latch variable between an unlatched state permitting movement of the cover to the open position and a latched state inhibiting movement of the cover to the open position;

a hands-free mechanism coupled to the latch and including a foot pedal, the hands-free mechanism movable to vary the latch from the latched state to the unlatched state and to move the cover from the closed position to the open position;

a first linkage coupled between the latch and the foot pedal; and a second linkage coupled between the cover and the foot pedal, wherein the foot pedal has a normal position in which the latch is in the latched state and the cover is in the closed position.

11. The cart of claim 10, wherein the foot pedal is movable a first distance relative to the second linkage to vary the latch to the unlatched state.

12. The cart of claim 11, wherein the latch is movable between a first position corresponding to the latched state and a second position corresponding to the unlatched state, and wherein the foot pedal engages the first linkage to move the latch from the first position to the second position and engages the second linkage to move the cover to the open position.

13. The cart of claim 10, wherein movement of the foot pedal a first distance from the normal position engages the first linkage without engaging the second linkage to vary the latch to the unlatched state, wherein movement of the foot pedal an additional second distance beyond the first distance engages the first linkage and the second linkage to hold the latch in the unlatched state and to move the cover toward the open position.

14. The cart of claim 10, wherein the second linkage includes a plate engaged with the cover and pivotable about an axis to pivot the cover toward the open position in response to movement of the foot pedal.

15. The cart of claim 10, wherein the latch is biased to the latched state to hold the cover in the closed position, and wherein the latch is configured to be temporarily varied to the unlatched state to permit movement of the cover to the open position.

16. The cart of claim 15, wherein the latch remains in the unlatched state when the cover moves between the closed position and the open position.

17. A cart comprising:

a container defining an interior space;

a cover movable between an open position providing access to the interior space and a closed position inhibiting access to the interior space;

a latch variable between an unlatched state in which the latch is disengaged from one of the container and the cover to permit movement of the cover to the open position, and a latched state in which the latch is engaged with the one of the container and the cover to inhibit movement of the cover to the open position;

a caddy supporting the container and including a hands-free mechanism having a foot pedal operatively coupled to the latch and the cover to vary the latch between the latched state and the unlatched state and to move the cover from the closed position to the open position;

a first linkage coupled between the latch and the foot pedal; and a second linkage coupled between the cover and the foot pedal.

18. The cart of claim 17, wherein the foot pedal has a normal position in which the latch is in the latched state and the cover is in the closed position.

19. The cart of claim 18, wherein movement of the foot pedal a first distance from the normal position engages the first linkage without engaging the second linkage to vary the latch to the unlatched state, and wherein movement of the foot pedal an additional second distance beyond the first distance engages the first linkage and the second linkage to hold the latch in the unlatched state and to move the cover toward the open position.

20. The cart of claim 19, wherein the caddy has a frame member, wherein the second linkage has a tubular member at least partially surrounding the frame member and a rod coupled between the foot pedal and the tubular member and movable in response to movement of the foot pedal the second distance, and wherein the tubular member is pivotable about the frame member to pivot the cover toward the open position in response to movement of the rod.

21. The cart of claim 20, wherein the cover pivots about an axis, and wherein movement of the foot pedal the second distance engages the second linkage to pivot the cover about the pivot point toward the open position.

22. The cart of claim 21, wherein the second linkage includes a plate engaged with the cover and pivotable about an axis, and wherein movement of the foot pedal the second distance engages the second linkage to pivot the plate and the cover about the axis toward the open position.

23. The cart of claim 22, wherein the latch is pivotably coupled adjacent a distal end of the plate.

24. The cart of claim 22, wherein the first linkage includes a cable operatively coupled to and routed from the foot pedal to the latch to move the latch to the unlatched state in response to movement of the foot pedal the first distance.

25. The cart of claim 24, wherein the cable extends through the latch.

26. The cart of claim 24, wherein the first linkage further includes a cable guide coupled to the frame member, and wherein the cable is routed over the cable guide and under the plate to the latch.

27. The cart of claim 24, wherein the latch is biased to the latched state to hold the cover closed, and wherein movement of the foot pedal the first distance pulls the cable to move the latch against the bias to the unlatched state.

28. The cart of claim 27, wherein upon release of the foot pedal, the latch returns to the latched state.

29. The cart of claim 16, wherein the latch is biased to the latched state to hold the cover closed, wherein the latch is configured to be temporarily varied to the unlatched state to permit movement of the cover to the open position, and wherein the latch remains in the unlatched state when the cover moves between the closed position and the open position.

30. The cart of claim 8, wherein the first linkage includes a rigid linkage movable to disengage the latch.

31. The cart of claim 8, wherein the second linkage includes a plate engaged with the cover and pivotable about an axis, and a connector coupled between the hands-free mechanism and a rearward end of the plate to pivot the cover toward the open position in response to movement of the hands-free mechanism.

32. The cart of claim 10, wherein the first linkage includes a rigid linkage coupled between the latch and the foot pedal and movable in response to movement of the foot pedal to vary the latch between the latched state and the unlatched state.

33. The cart of claim 17, wherein the first linkage includes a rigid linkage operatively coupled to the foot pedal and the latch to move the latch between the latched state and the unlatched state in response to movement of the foot pedal a first distance.

34. The cart of claim 33, further comprising a bias mechanism coupled to the first linkage to bias the first linkage so that the latch remains in the latched state absent a force acting on the foot pedal.

35. The cart of claim 34, wherein the second linkage includes a plate engaged with the cover and pivotable about an axis, and wherein the bias mechanism is engaged with the plate to bias the latch to the latched state to hold the cover closed.

36. The cart of claim 35, wherein the caddy has a frame member, wherein the rigid linkage includes a first rod operatively coupled to the foot pedal and a second rod pivotably coupled to the first rod about the frame member to move the latch between the unlatched state and the latched state.

37. The cart of claim 36, wherein the first linkage further includes a pivot guide coupled to the frame member, and wherein the first rod and the second rod are pivotably coupled to the pivot guide.

38. The cart of claim 37, wherein the pivot guide is cylindrically-shaped.

39. The cart of claim 36, wherein the latch is biased to the latched state to hold the cover closed, and wherein movement of the foot pedal the first distance pulls the first rod to pull the second rod and move the latch against the bias of the bias mechanism to the unlatched state.

40. The cart of claim 39, wherein upon release of the foot pedal, the latch returns to the latched state.

41. The cart of claim 19, wherein the second linkage includes a plate engaged with the cover and pivotable about an axis, and a connector coupled between the foot pedal and a rearward end of the plate to pivot the cover toward the open position in response to movement of the foot pedal.

42. The cart of claim 10, wherein the second linkage further includes a plate a connector coupled between the foot pedal and a rearward end of the plate to pivot the cover toward the open position in response to movement of the foot pedal.

* * * * *